US009058807B2

(12) United States Patent
Tamura et al.

(10) Patent No.: US 9,058,807 B2
(45) Date of Patent: Jun. 16, 2015

(54) SPEECH SYNTHESIZER, SPEECH SYNTHESIS METHOD AND COMPUTER PROGRAM PRODUCT

(75) Inventors: Masatsune Tamura, Kanagawa (JP); Masahiro Morita, Kanagawa (JP); Takehiko Kagoshima, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1041 days.

(21) Appl. No.: 13/051,541

(22) Filed: Mar. 18, 2011

(65) Prior Publication Data

US 2012/0053933 A1 Mar. 1, 2012

(30) Foreign Application Priority Data

Aug. 30, 2010 (JP) ..... 2010-192656

(51) Int. Cl.
*G10L 13/00* (2006.01)
*G10L 13/04* (2013.01)
*G10L 25/18* (2013.01)

(52) U.S. Cl.
CPC *G10L 13/04* (2013.01); *G10L 25/18* (2013.01)

(58) Field of Classification Search
CPC ..... G10L 25/90; G10L 19/09; G10L 19/08; G10L 21/04; G10L 19/02; G10L 25/15; G10L 13/04; G10L 13/027; G10L 13/033; G10L 2021/0135; G10L 13/10; G10L 19/00; G10L 25/27; G10L 13/07; H05K 999/99; H04B 1/667
USPC ..... 704/207, 205, 268, 209, 261, E13.002, 704/E13.004, E13.005, E19.001, 258
See application file for complete search history.

(56) References Cited

U.S. PATENT DOCUMENTS 5,890,118 A * 3/1999 Kagoshima et al. ..... 704/265
2008/0040104 A1* 2/2008 Ide ..... 704/219

(Continued)

FOREIGN PATENT DOCUMENTS

JP 2001-051698 2/2001
JP 2002-268660 9/2002

OTHER PUBLICATIONS

Nishizawa et al., Separation of Voiced Source Characteristics and Vocal Tract Transfer Function Characteristics for Speech Sounds by Iterative Analysis Based on AR-HMM Model, 7th International Conference on Spoken Language Processing, ICSLP2002, pp. 1721-1724, Sep. 16-20, 2002.*

(Continued)

*Primary Examiner* — Brian Albertalli
(74) *Attorney, Agent, or Firm* — Amin, Turocy & Watson, LLP

(57) ABSTRACT

According to one embodiment, a first storage unit stores n band noise signals obtained by applying n band-pass filters to a noise signal. A second storage unit stores n band pulse signals. A parameter input unit inputs a fundamental frequency, n band noise intensities, and a spectrum parameter. A extraction unit extracts for each pitch mark the n band noise signals while shifting. An amplitude control unit changes amplitudes of the extracted band noise signals and band pulse signals in accordance with the band noise intensities. A generation unit generates a mixed sound source signal by adding the n band noise signals and the n band pulse signals. A generation unit generates the mixed sound source signal generated based on the pitch mark. A vocal tract filter unit generates a speech waveform by applying a vocal tract filter using the spectrum parameter to the generated mixed sound source signal.

13 Claims, 19 Drawing Sheets

(56) References Cited

U.S. PATENT DOCUMENTS

| | | | | |
|---|---|---|---|---|
| 2009/0144053 | A1* | 6/2009 | Tamura et al. | 704/207 |
| 2009/0177474 | A1 | 7/2009 | Morita et al. | |

OTHER PUBLICATIONS

Heiga Zen, et al., "An Overview of Nitech HMM-based Speech Synthesis System for Blizzard Challenge 2005", Proc. of Interspeech 2005 (Eurospeech), Lisbon, Sep. 2005, pp. 93-96.

* cited by examiner

SPEECH SYNTHESIZER, SPEECH SYNTHESIS METHOD AND COMPUTER PROGRAM PRODUCT

CROSS-REFERENCE TO RELATED APPLICATIONS

This application is based upon and claims the benefit of priority from Japanese Patent Application No. 2010-192656, filed on Aug. 30, 2010; the entire contents of which are incorporated herein by reference.

FIELD

Embodiments described herein relate generally to a speech synthesizer, a speech synthesis method, and a computer program product.

BACKGROUND

An apparatus that generates a speech waveform from speech feature parameters is called a speech synthesizer. As an example of speech synthesizer, a source-filter type speech synthesizer is used. The source-filter type speech synthesizer receives a sound source signal (excitation source signal), which is generated from a pulse source signal representing sound source components generated by vocal cord vibrations and a noise source signal representing sound sources originated from turbulent flows of air or the like, and generates a speech waveform by filtering using parameters of a spectrum envelope representing vocal tract characteristics or the like. A sound source signal can be created by simply using a pulse signal and a Gaussian noise signal and switching these signals. The pulse signal is created according to pitch information obtained from a fundamental frequency sequence and is used in a voiced sound interval. The Gaussian noise signal is used in an unvoiced sound interval. As a vocal tract filter, an all-pole filter with a linear prediction coefficient used as a spectrum envelope parameter, a lattice-type filter for the PARCOR coefficient, an LSP synthetic filter for an LSP parameter, or a Logarithmic Magnitude Approximate (LMA) filter for a cepstrum parameter is used. As a vocal tract filter, a mel all-pole filter for mel LPC, an Mel Logarithmic Spectrum Approximate filter (MLSA for mel cepstrum), or an Mel Generalized Logarithmic Spectrum Approximate (MGLSA) filter for mel generalized cepstrum is also used.

A sound source signal used for such a source-filter type speech synthesizer can be created by, as described above, switching a pulse sound source signal and a noise source signal. However, when the simple switching of the pulse and noise is applied to a signal such as a voiced fricative, in which a noise component and a periodic component are mixed such that a higher frequency domain becomes a noise-like signal and a lower frequency domain a periodic signal, voice quality becomes unnatural with a buzzing or a rough quality of generated sound.

To deal with this problem, a technology like Mixed Excitation Linear Prediction (MELP) to prevent degradation by a buzz or a buzzer-like sound generated by switching between a band higher than a certain frequency regarded as a noise source and a lower band regarded as a pulse sound source is proposed. Also, to create a mixed sound source appropriately, a technology that divides a signal into sub-bands and mixes a noise source and a pulse sound source for each sub-band according to a mixing ratio is used.

However, the conventional technologies have a problem in that a waveform cannot be generated at high speed because a band-pass filter is applied to a noise signal and a pulse signal when a reproduced speech is generated.

DETAILED DESCRIPTION

In general, according to one embodiment, a first storage unit stores n band noise signals obtained by applying n band-pass filters to a noise signal. A second storage unit stores n band pulse signals obtained by applying the n band-pass filters to a pulse signal. A parameter input unit inputs a fundamental frequency, n band noise intensities, and a spectrum parameter. A extraction unit extracts band noise signals for each sample from the n band noise signals stored in the second storage unit while shifting. An amplitude control unit changes amplitudes of the extracted band noise signals and band pulse signals in accordance with the band noise intensities. A generation unit generates a mixed sound source signal by adding the n band noise signals and the n band pulse signals. A second generation unit generates the mixed sound source signal for the speech based on the pitch mark. A vocal tract filter unit generates a speech waveform by applying a vocal tract filter using the spectrum parameter to the generated mixed sound source signal.

Exemplary embodiments of the speech synthesizer will be described in detail below with reference to the accompanying drawings.

A speech synthesizer according to a first embodiment stores therein pulse signals (band pulse signals) and noise signals (band noise signals) to which band-pass filters are applied in advance. By generating a sound source signal of a source filter model using extracted band noise signals extract while cyclically shifting or reciprocally shifting the band noise signals, the speech synthesizer generates a speech waveform at high speed.

Figure 1:
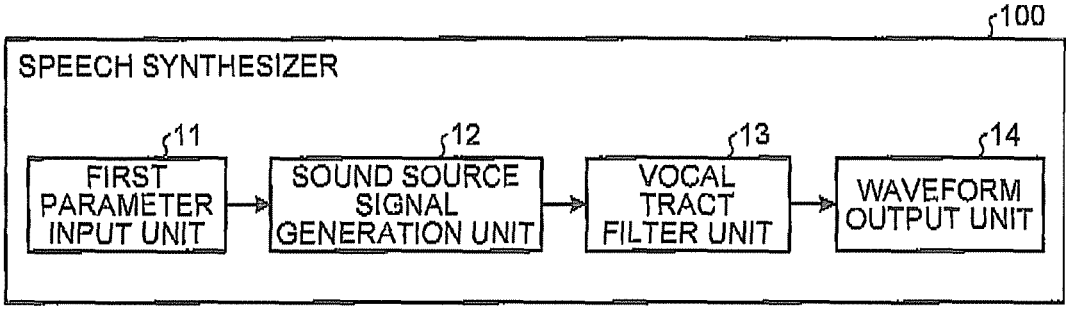
FIG. 1 is a block diagram of a speech synthesizer according to a first embodiment.

FIG. 1 is a block diagram exemplifying the configuration of a speech synthesizer 100 according to the first embodiment. The speech synthesizer 100 is a source-filter type speech synthesizer that generates a speech waveform by receiving a speech parameter sequence composed of a fundamental frequency sequence of speech to be synthesized, a band noise intensity sequence, and a spectrum parameter sequence.

As illustrated in FIG. 1, the speech synthesizer 100 includes a first parameter input unit 11, a sound source signal generation unit 12 that generates a sound source signal, a vocal tract filter unit 13 that applies a vocal tract filter, and a waveform output unit 14 that outputs a speech waveform.

The first parameter input unit 11 receives characteristic parameters to generate a speech waveform. The first parameter input unit 11 receives a characteristic parameter sequence containing at least a sequence representing information of a fundamental frequency or fundamental period (hereinafter, referred to as a fundamental frequency sequence) and a spectrum parameter sequence.

As the fundamental frequency sequence, a sequence of a value of the fundamental frequency in a voiced sound frame and a preset value indicating an unvoiced sound frame, which is for example a value fixed to 0 for an unvoiced sound frame, is used. In a voiced sound frame, values such as a pitch period for each frame of a periodic signal and the fundamental frequency ($F_0$) or logarithmic $F_0$ are recorded. In the present embodiment, a frame indicates an interval of a speech signal. When an analysis is performed at a fixed frame rate, characteristic parameters are provided at intervals of, for example, 5 ms.

Spectrum parameters represent spectrum information as parameters. When an analysis of spectrum parameters is performed at a fixed frame rate similarly to the fundamental frequency sequence, parameter sequences corresponding to intervals of, for example, every 5 ms are accumulated. While various parameters can be used as spectrum parameters, in the present embodiment, a case where a mel LSP is used as a parameter will be described. In this case, spectrum parameters corresponding to one frame are composed of a term representing a one-dimensional gain component and a p-dimensional line spectrum frequency. The source-filter type speech synthesizer receives the fundamental frequency sequence and spectrum parameter sequence to generate a speech.

In the present embodiment, the first parameter input unit 11 further receives a band noise intensity sequence. The band noise intensity sequence is information representing the intensity of a noise component in a predetermined frequency band in the spectrum of each frame as a ratio to the whole spectrum of the applicable band. The band noise intensity is represented by the value of ratio or the value obtained by conversion of the value of ratio into dB. Thus, the first parameter input unit 11 receives the fundamental frequency sequence, spectrum parameter sequence, and band noise intensity sequence.

Figure 2:
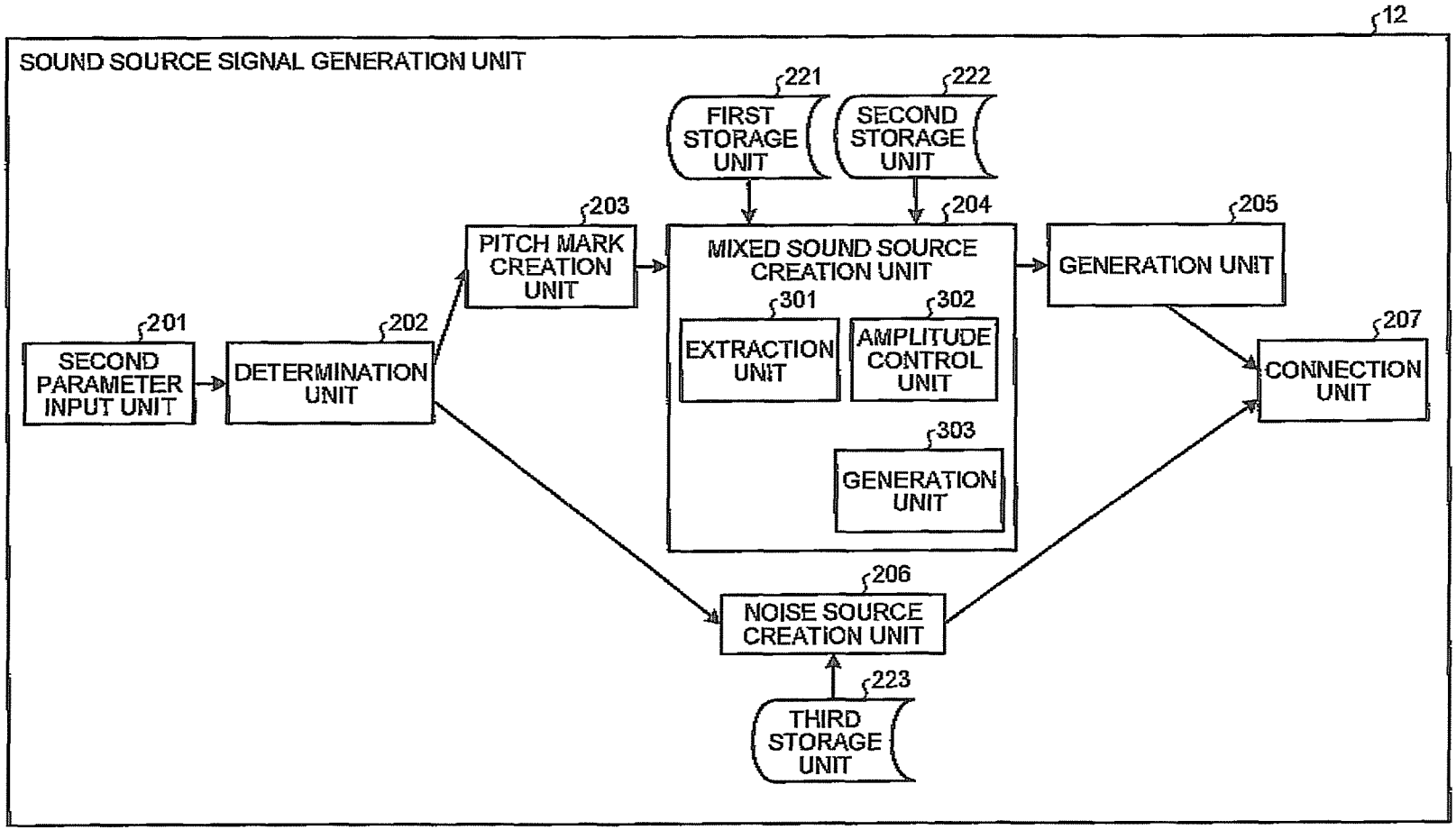
FIG. 2 is a block diagram of a sound source signal generation unit.

The sound source signal generation unit 12 generates a sound source signal from the input fundamental frequency sequence and band noise intensity sequence. FIG. 2 is a block diagram showing a configuration example of the sound source signal generation unit 12. As illustrated in FIG. 2, the sound source signal generation unit 12 includes a first storage unit 221, a second storage unit 222, a third storage unit 223, a second parameter input unit 201, a determination unit 202, a pitch mark creation unit 203, a mixed sound source creation unit 204, a generation unit 205, a noise source creation unit 206, and a connection unit 207.

The first storage unit 221 stores therein band noise signals, which represent predetermined n (n is an integer equal to or greater than 2) noise signals obtained by applying n band-pass filters that respectively allow frequency bands of n passing bands to pass to a noise signal. The second storage unit 222 stores therein band pulse signals, which represent n pulse signals obtained by applying the n band-pass filters to a pulse signal. The third storage unit 223 stores therein a noise signal to create an unvoiced sound source. An example in which n=5, that is, five band noise signals and five band pulse signals obtained by band-pass filters of 5-divided passing bands are used will be described below.

The first storage unit 221, the second storage unit 222, and the third storage unit 223 can comprise any storage medium that is generally used, such as a Hard Disk Drive (HDD), optical disk, memory card, or Random Access Memory (RAM).

The second parameter input unit 201 receives the input fundamental frequency sequence and band noise intensity sequence. The determination unit 202 determines whether a focused frame in the fundamental frequency sequence is an unvoiced sound frame. If, for example, the value of an unvoiced sound frame is set to 0 in the fundamental frequency sequence, the determination unit 202 determines whether the focused frame is an unvoiced sound frame by determining whether the value of the relevant frame is 0.

The pitch mark creation unit 203 creates a pitch mark sequence if a frame is a voiced sound frame. The pitch mark sequence is information indicating a sequence of times to arrange a pitch pulse. The pitch mark creation unit 203 defines a reference time, calculates a pitch period for the reference time from a value of a frame in the fundamental frequency sequence, and allocates a mark to the time advanced by the length of the pitch period. By repeating these processes, the pitch mark creation unit 203 creates pitch marks. The pitch mark creation unit 203 calculates the pitch period by determining an inverse of the fundamental frequency.

The mixed sound source creation unit 204 creates a mixed sound source signal. In the present embodiment, the mixed sound source creation unit 204 creates a mixed sound source signal by waveform superimposition of a band noise signal and a band pulse signal. The mixed sound source creation unit 204 includes an extraction unit 301, an amplitude control unit 302, and a generation unit 303.

For each pitch mark of speech to be synthesized, the extraction unit 301 extracts each of n band noise signals stored in the first storage unit 221 while performing shifting. A band noise signal stored in the first storage unit 221 has a finite length so that it is necessary to repeatedly use the finite band noise signal when band noise is extracted. The shift is a method of deciding a sample point in a band noise signal, whereby a sample, which is adjacent to a band noise signal sample that is used at a point in time, is used at the next point in time. Such a shift is realized by, for example, a cyclic shift or a reciprocal shift. Thus, the extraction unit 301 extracts a sound source signal of an arbitrary length from a finite band noise signal by, for example, the cyclic shift or the reciprocal shift. According to the cyclic shift, a band noise signal prepared in advance is sequentially used from the head. When reaching the end point, the band noise signal is used again from the head by considering the head as a subsequent point of the end point. According to the reciprocal shift, when reaching the end point, the band noise signal is sequentially used in the reverse direction toward the head, and when reaching the head, the band noise signal is sequentially used toward the and point.

The amplitude control unit 302 performs amplitude control to change the amplitude of the extracted band noise signals and the amplitude of band pulse signals stored in the second storage unit 222 in accordance with the input band noise intensity sequence for each of n bands. The generation unit 303 generates a mixed sound source signal for each pitch mark after adding amplitude-controlled n band noise signals and n band pulse signals.

The generation unit 205 creates a mixed sound source signal, which is a voiced sound source, by superimposing and synthesizing a mixed sound source signal obtained by the generation unit 303 according to the pitch mark.

When determined to be an unvoiced sound by the determination unit 202, the noise source creation unit 206 creates a noise source signal using a noise signal stored in the third storage unit 223.

The connection unit 207 connects mixed sound source signal corresponding to a voiced sound interval obtained by the generation unit 205 and a noise source signal corresponding to an unvoiced sound interval obtained by the noise source creation unit 206.

Returning to FIG. 1, the vocal tract filter unit 13 generates a speech waveform from a sound source signal obtained by the connection unit 207 and a spectrum parameter sequence. If a mel LSP parameter is used, for example, the vocal tract filter unit 13 makes a conversion from mel LSP to mel LPC and uses a mel LPC filter for filtering to generate a speech waveform. The vocal tract filter unit 13 may generate a speech waveform by applying a filter that directly generates a waveform from mel LSP without converting mel LSP into mel LPC. The spectrum parameter is not limited to mel LSP. Any spectrum parameter such as cepstrum, mel cepstrum, linear prediction coefficient and the like, which can represent a spectrum envelope as parameters and can generate waveform functioning as a vocal tract filter, may be used. When a spectrum parameter other than mel LSP is used, the vocal tract filter unit 13 generates a waveform by applying a vocal tract filter corresponding to the parameter. The waveform output unit 14 outputs an obtained speech waveform.

Figure 3:
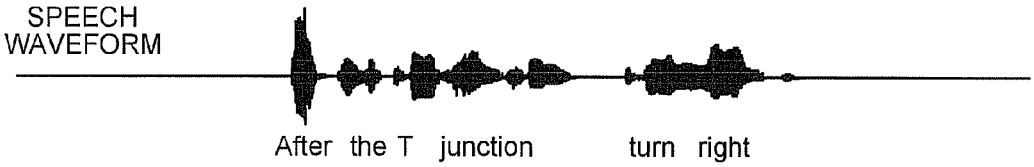
FIG. 3 is a diagram exemplifying a speech waveform.

A specific example of speech synthesis by the speech synthesizer 100 configured as described above will be described below. FIG. 3 is a diagram showing an example of the speech waveform used for the description below. FIG. 3 shows the speech waveform of a speech "After the T-Junction, turn right." Hereinafter, an example will be described in which the speech waveform shown in FIG. 3 is used and a waveform is generated from speech parameters analyzed.

Figure 4:
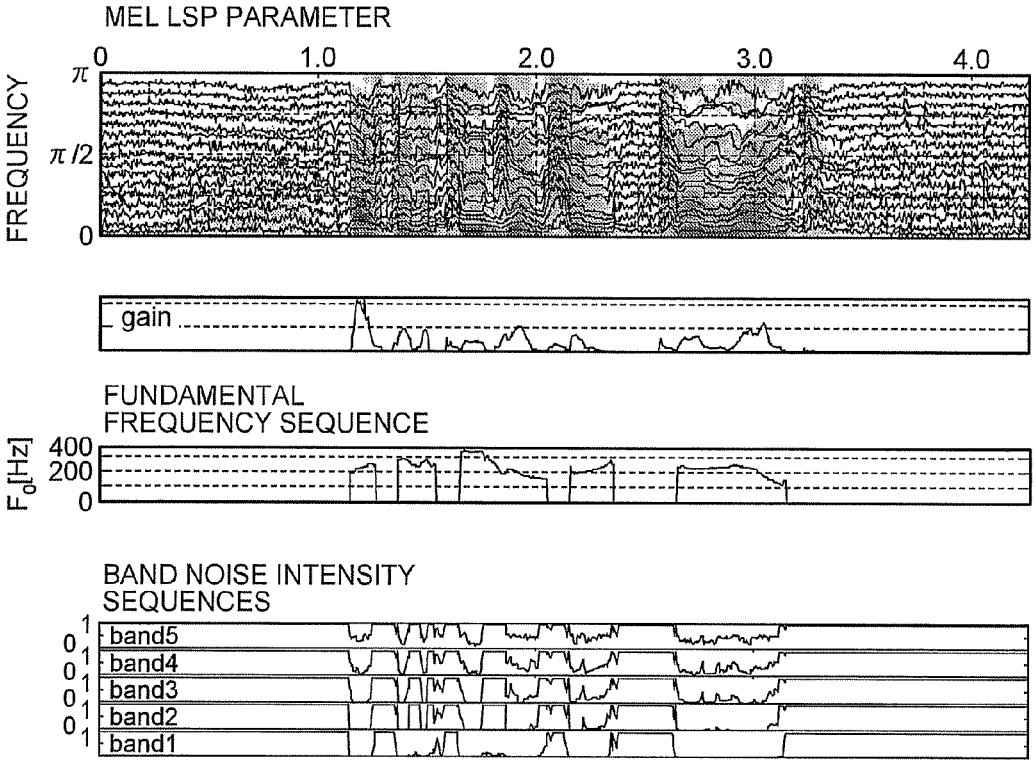
FIG. 4 is a diagram exemplifying parameters to be input.

FIG. 4 is a diagram exemplifying the spectrum parameter sequence (mel LSP parameter), fundamental frequency sequence, and band noise intensity sequences input by the first parameter input unit 11. The mel LSP parameter is obtained by converting a linear prediction analysis result and is represented as a frequency value. The mel LSP parameter is an LSP parameter determined on a mel frequency scale and is created by conversion from a mel LPC parameter. The mel LSP parameter in FIG. 4 is obtained by plotting the mel LSP parameter on a spectrogram of speech. The mel LSP parameter changes like noise in a silent interval or a noise-like interval and changes more like a formant frequency in a voiced sound interval. The mel LSP parameter is represented by a gain term and, in the example in FIG. 4, a 16th order parameter and a gain component is shown at the same time.

The fundamental frequency sequence is represented in Hz in the example in FIG. 4. The fundamental frequency sequence has 0 in an unvoiced sound interval and a voiced sound interval has the value of the fundamental frequency thereof.

The band noise intensity sequence is, in the example in FIG. 4, a parameter that shows the intensity of a noise component in each of 5-divided bands (band 1 to band 5) in a ratio to a spectrum and takes a value between 0 and 1. All bands are considered as noise components in an unvoiced sound interval and thus, the value of band noise intensity becomes 1. In a voiced sound interval, the band noise intensity has a value less than 1. Generally, a noise component becomes stronger in a high-frequency band. The band noise intensity takes a value close to 1 for a high-frequency component of a voiced fricative. The fundamental frequency sequence may be a logarithmic fundamental frequency and the band, noise intensity may be held in dB.

Figure 5:
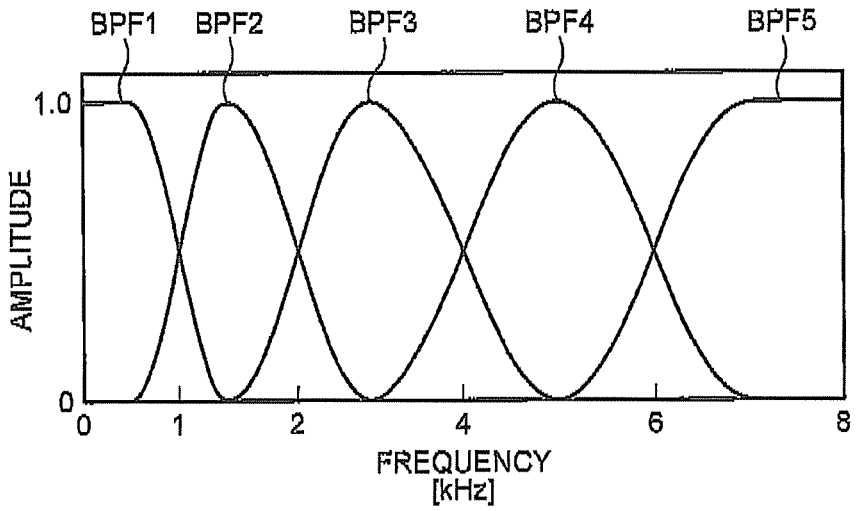
FIG. 5 is a diagram exemplifying specifications of a band-pass filter.

As described above, the first storage unit 221 stores therein band noise signals corresponding to parameters of the band noise intensity sequences. The band noise signals are created by applying band-pass filters to a noise signal. FIG. 5 is a diagram exemplifying specifications of the band-pass filters. FIG. 5 illustrates amplitudes of five filters BPF1 to BPF5 with respect to the frequency. In the example in FIG. 5, a 16-kHz sampling speech signal is used, 1 kHz, 2 kHz, 4 kHz, and 6 kHz are set as boundaries, and shapes are created by a Hanning window function represented by Formula (1) below centering on a center frequency between boundaries.

$$w(x)=0.5-0.5\cos(2\pi x) \tag{1}$$

Figure 6:
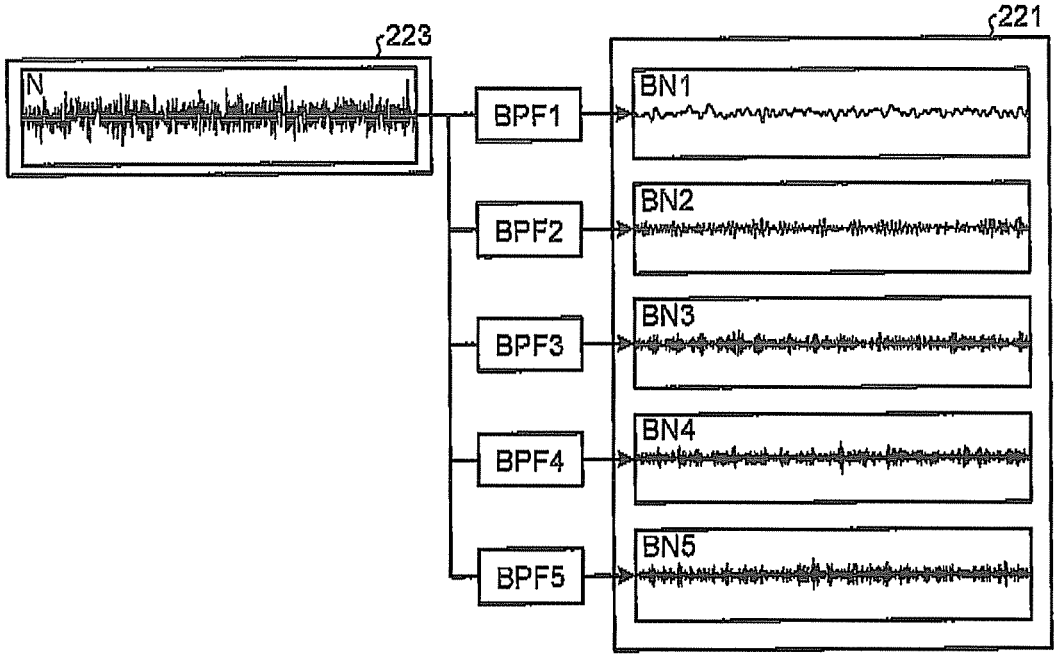
FIG. 6 is a diagram exemplifying a noise signal and band noise signals created from the noise signal.
Figure 7:
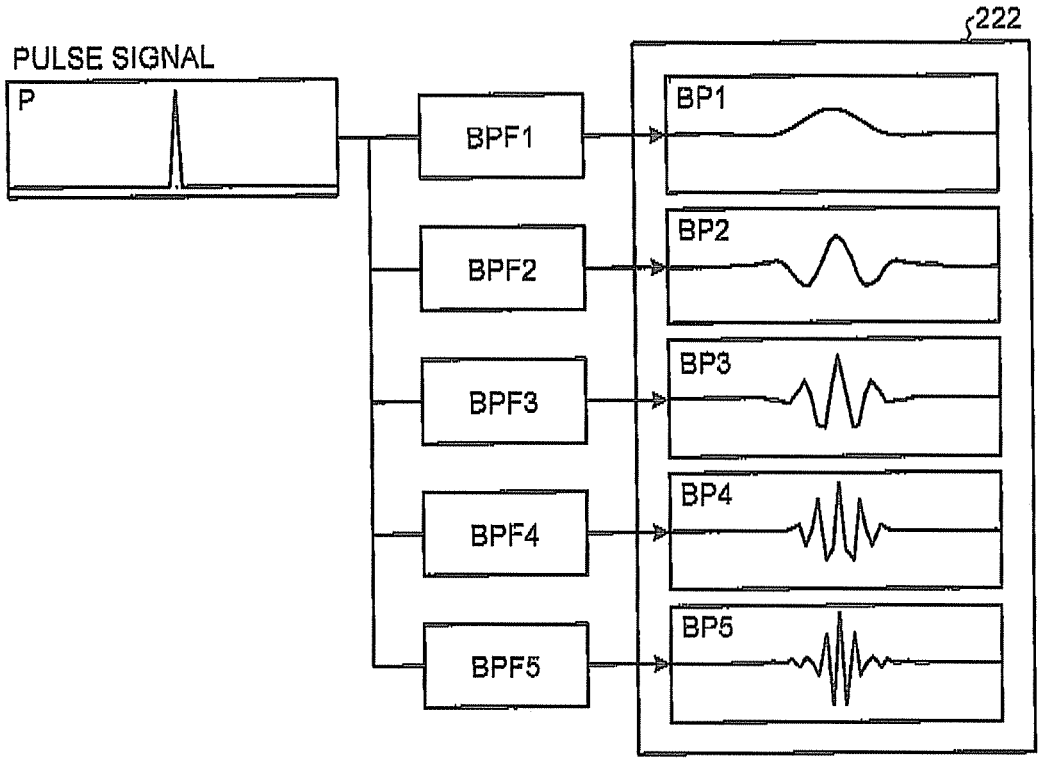
FIG. 7 is a diagram exemplifying a band pulse signal created from a pulse signal.

From frequency characteristics as defined above, a band-pass filter is created, and then a band noise signal and a band pulse signal are created by applying the band-pass filter to a noise signal. FIG. 6 is a diagram exemplifying a noise signal stored in the third storage unit 223 and band noise signals created from the noise signal and stored in the first storage unit 221. FIG. 7 is a diagram exemplifying band pulse signals created from a pulse signal and stored in the second storage unit 222.

FIG. 6 illustrates an example in which band noise signals BN1 to BN5 are created by applying the band-pass filters BPF1 to BPF5 having amplitude characteristics illustrated in FIG. 5 to a noise signal of 64 ms (1024 points). FIG. 7 illustrates an example in which, according to a similar procedure, band pulse signals BP1 to BP5 are created by applying the band-pass filters BPF1 to BPF5 to a pulse signal P. In FIG. 7, a signal of length 3.125 ms (50 points) is created.

BPF1 to BPF5 in FIGS. 6 and 7 are filters created based on frequency characteristics in FIG. 5. BPF1 to BPF5 are created by applying inverse FFT to each amplitude characteristic with zero phase and a Hanning window to edges. A band noise signal is created by convolution using a filter obtained in this manner. As illustrated in FIG. 6, the third storage unit 223 stores therein a noise signal N before a band-pass filter is applied.

FIGS. 8 to 12 are diagrams illustrating an operation example of the speech synthesizer 100 illustrated in FIG. 1. The second parameter input unit 201 of the sound source signal generation unit 12 receives the above-described fundamental frequency sequence and band noise intensity sequences. The determination unit 202 determines whether or not the value of the fundamental frequency sequence of the frame to be processed is 0. If the value is other than 0, that is, the frame is a voiced sound frame, the process proceeds to the pitch mark creation unit 203.

Figure 8:
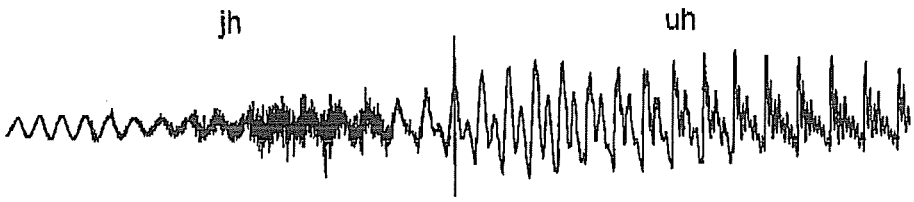
FIG. 8 is a diagram, a speech waveform.

The pitch mark creation unit 203 creates a pitch mark sequence from the fundamental frequency sequence. FIG. 8 illustrates a speech waveform used as an example. This speech waveform is an enlarged waveform between near 1.8 s and near 1.95 s (near "ju" of T-junction) of the fundamental frequency sequence illustrated in FIG. 4.

Figure 9:
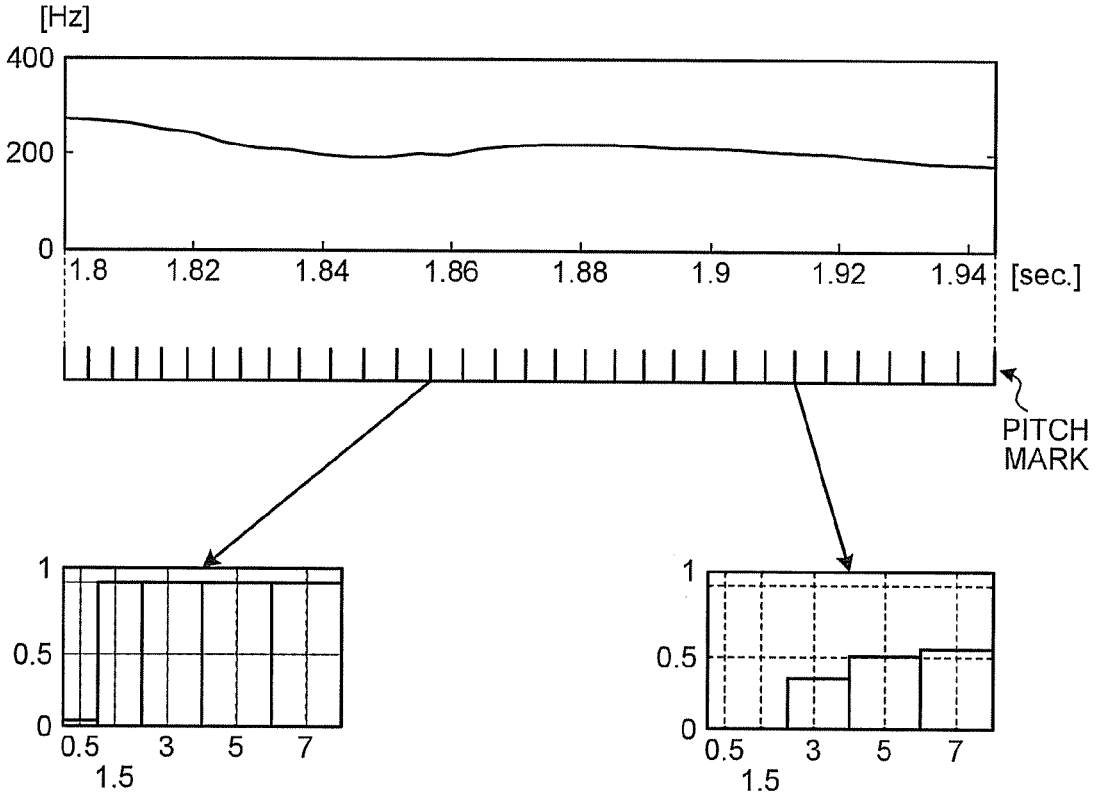
FIG. 9 is a diagram exemplifying a fundamental frequency sequence, pitch mark, and band noise intensity sequence.

FIG. 9 is a diagram exemplifying the fundamental frequency sequence, pitch marks, and band noise intensity sequences corresponding to the speech waveform (speech signal) in FIG. 8. The graph in the upper part of FIG. 9 shows the fundamental frequency sequence of the speech waveform in FIG. 8. The pitch mark creation unit 203 creates a pitch mark as illustrated in the center of FIG. 9 by repeating the processes of setting the starting point from the fundamental frequency sequence, determining the pitch period from the fundamental frequency in the current position, and setting the time obtained by adding the pitch period as the next pitch mark.

The mixed sound source creation unit 204 creates a mixed sound source signal in each pitch mark from the pitch mark sequence and band noise intensity sequence. Two graphs in the lower part of FIG. 9 illustrate examples of the band noise intensity in the pitch mark near 1.85 s and 1.91 s. The horizontal axis of these graphs is the frequency and the vertical axis is intensity (value ranging from 0 to 1). The left graph of these two graphs corresponds to the phoneme "j" and is a voiced fricative interval. Thus, a noise component increases in a high-frequency band to be close to 1.0. The right graph of these two graphs corresponds to the phoneme "u" of voiced sound and is close to 0 in a low-frequency band and is at about 0.5 even in a high-frequency band. The band noise intensity corresponding to each pitch mark can be created by linear interpolation from band noise intensity of frames adjacent to each pitch mark.

Figure 10:
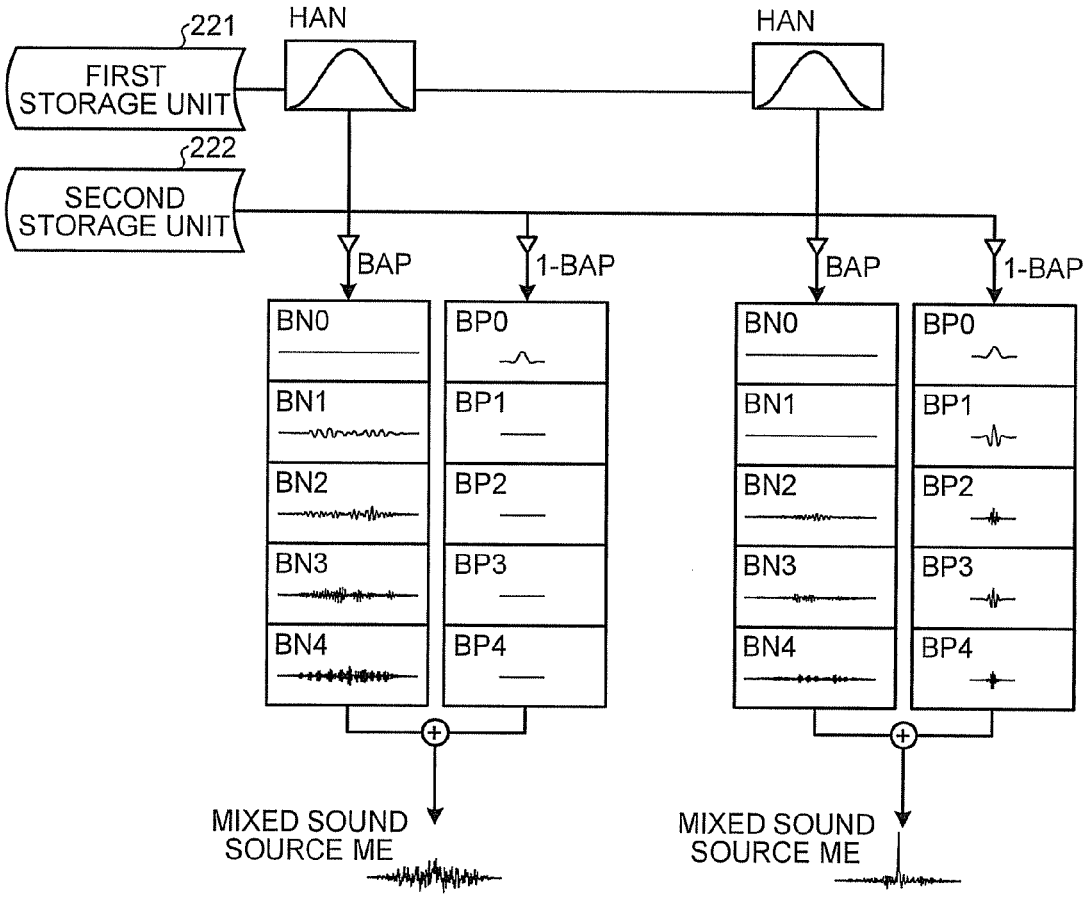
FIG. 10 is a diagram illustrating details of processing by a mixed sound source creation unit.

FIG. 10 is a diagram illustrating details of processing by the mixed sound source creation unit 204 that creates a mixed sound source signal. First, the extraction unit 301 extracts a band noise signal by applying a Hanning window (HAN) whose length is twice the pitch to the band noise signal of each band stored in the first storage unit 221. The extraction unit 301 extracts a band noise signal $bn^b_p(t)$ according to formula (2) when the cyclic shift is used:

$$bn^b_p(t) = \text{bandnoise}^b(t \ \% \ B^b) * \left(0.5 - 0.5\cos\left(\frac{\pi}{\text{pit}}(t - pm)\right)\right) \tag{2}$$

$bn^b_p(t)$ denotes a band noise signal at time t, in the band b, and in the pitch mark p. $\text{bandnoise}^b$ denotes a band noise signal of a band b stored in the first storage unit 221. $B^b$ denotes the length of $\text{bandnoise}^b$. % denotes a remainder operator, pit denotes a pitch, and pm denotes a pitch mark time. "0.5−0.5 cos(t)" denotes the formula of a Hanning window.

The amplitude control unit 302 creates band noise signals of BN0 to BN4 by multiplying the band noise signal of each band extracted according to Formula (2) by band noise intensity BAP (b) of each band. The amplitude control unit 302 creates band pulse signals of BP0 to BP4 by multiplying band pulse signals stored in the second storage unit 222 by (1.0−BAP (b)). The amplitude control unit 302 creates a mixed sound source signal ME by adding the band noise signals (BN0 to BN4) and the band pulse signals (BP0 to BP4) while aligning the center positions thereof.

That is, the amplitude control unit 302 creates a mixed sound source signal $me_p$ (t) by Formula (3) shown below, where $\text{bandnoise}^b$ (t) denotes the pulse signal of the band b and it is assumed that $\text{bandnoise}^b$ (t) is created in such a way that the center thereof is at time 0.

$$me_p(t) = \sum_b BAP(b)bn^b_p(t) + (1.0 - BAP(b))\text{bandpulse}^b(t - pm) \tag{3}$$

With the above processing, the mixed sound source signal in each pitch mark is created. When the reciprocal shift is used instead of the cyclic shift, Formula (2) is changed as follows: the portion of t % $B^b$ is set as t=0 at time 0, then successively moves by setting t=t+1 and when t=$B^b$, the portion moves by setting t=t−1 and when t=0 again, the portion moves by setting t=t+1. That is, in the cyclic shift, the band noise signal is shifted successively from the starting point, and when reaching the end point, the signal is shifted to the starting point at the next time, and this shift is repeated. In the reciprocal shift, the process of making a shift in the reverse direction at the next time after reaching the end point is repeated.

Figure 11:
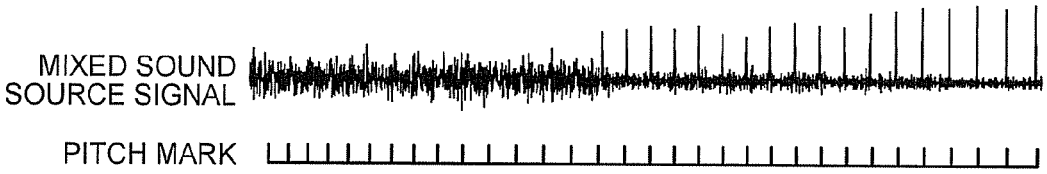
FIG. 11 is a diagram illustrating an example of a mixed sound source signal created by a generation unit.

Next, the generation unit 205 creates a mixed sound source signal for the whole interval by superimposing created mixed sound source signals according to the pitch mark created by the pitch mark creation unit 203. FIG. 11 is a diagram showing an example of the mixed sound source signal created by the generation unit 205. As can be seen from FIG. 11, an appropriate mixed sound source signal that has strong a noise signal in a voiced fricative interval and a strong pulse signal in a vowel interval is created by the above processing.

The above processing is intended for a voiced sound interval. A noise source signal of an unvoiced sound interval or silent interval synthesized from a noise signal stored in the third storage unit 223 is created for an unvoiced sound interval. For example, by copying a stored noise signal, a noise source signal of an unvoiced sound interval is created.

The connection unit 207 creates a sound source signal of the whole sentence by connecting mixed sound source signals in voiced sound intervals created as described above and noise source signals of unvoiced sound or silent intervals. A multiplication of the band noise intensity is performed in Formula (3). In addition, a multiplication of a value that controls the amplitude may also be performed. For example, an appropriate sound source signal is created by a multiplication of a value so as to make the amplitude of a spectrum of a sound source signal determined by the pitch equal to 1.

Figure 12:
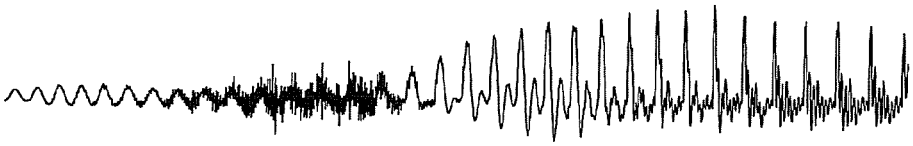
FIG. 12 is a diagram exemplifying a speech waveform.

Next, the vocal tract filter unit 13 applies a vocal tract filter according to the spectrum parameter (mel LSP parameter) to a sound source signal obtained by the connection unit 207 to generate a speech waveform. FIG. 12 is a diagram exemplifying the obtained speech waveform.

Figure 13:
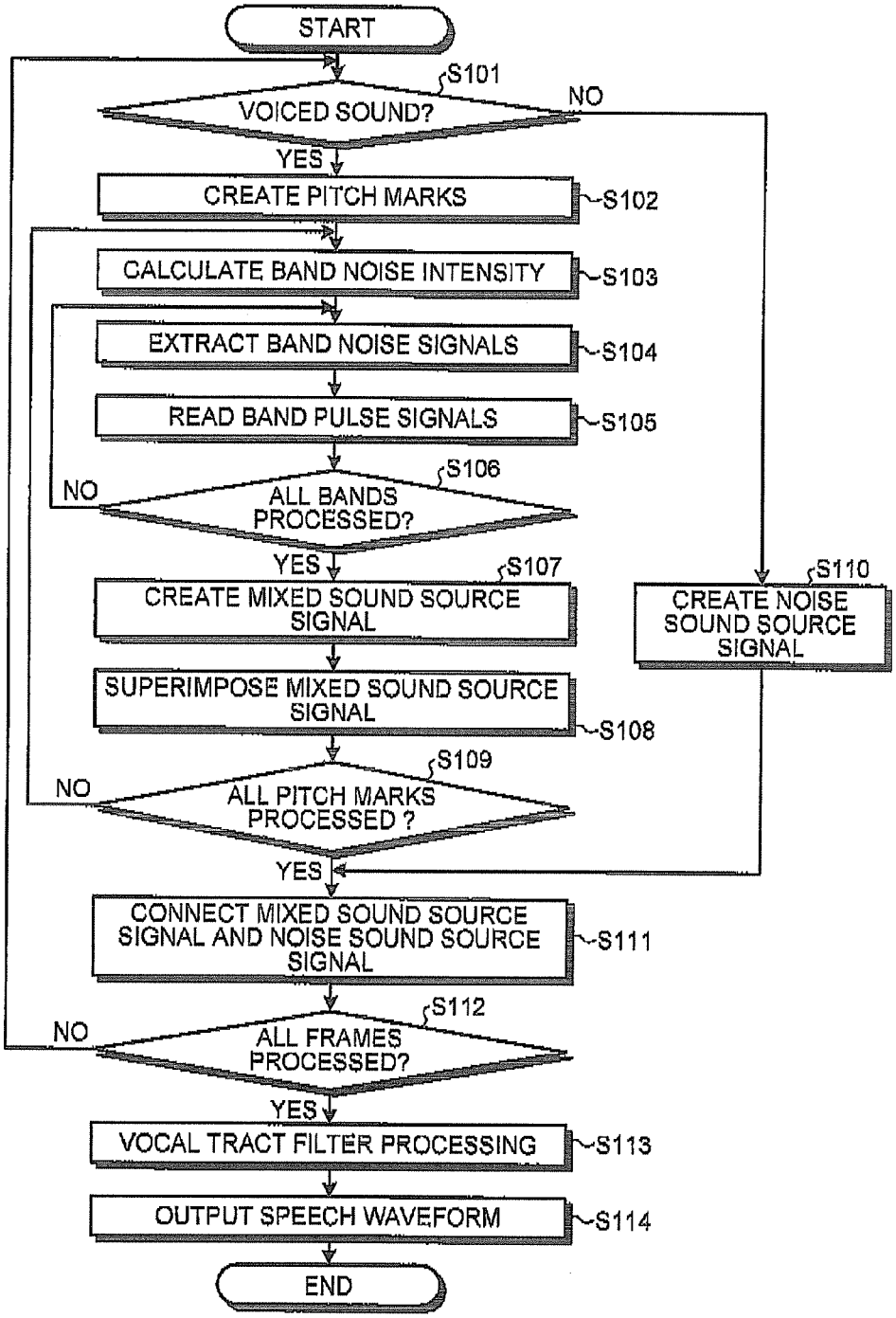
FIG. 13 is a flow chart illustrating the overall flow of speech synthesis processes in the first embodiment.

Next, speech synthesis processing by the speech synthesizer 100 according to the first embodiment will be described. FIG. 13 is a flow chart illustrating the overall flow of speech synthesis processes according to the first embodiment.

The processes in FIG. 13 start after the fundamental frequency sequence, spectrum parameter sequence, and band noise intensity sequences are input by the first parameter input unit 11 and are performed in units of speech frames.

First, the determination unit 202 determines whether or not the frame to be processed is a voiced sound (step S101). If the frame is determined to be a voiced sound frame (step S101: Yes), the pitch mark creation unit 203 creates a pitch mark sequence (step S102). Then, processes of step S103 to step S108 are performed by looping in units of pitch marks.

First, the mixed sound source creation unit 204 calculates band noise intensity of each band in each pitch mark from the input band noise intensity sequence (step S103). Then, processes in step S104 and step S105 are repeatedly performed for each band. That is, the extraction unit 301 extracts a band noise signal of the band currently being processed from the band noise signal of the corresponding band stored in the first storage init 221 (step S104). The mixed sound source creation unit 204 reads the band pulse signal of the band currently being processed from the second storage unit 222 (step S105).

The mixed sound source creation unit 204 determines whether all bands have been processed (step S106) and, if all bands have not yet been processed (step S106: No), returns to step S104 to repeat the processes for the next band. If all bands have been processed (step S106: Yes), the generation unit 303 adds the band noise signal and band pulse signal obtained for each band to create a mixed sound source signal of all bands (step S107). Next, the generation unit 205 superimposes the obtained mixed sound source signal (step S108).

Next, the mixed sound source creation unit 204 determines whether processes have been performed for all pitch marks (step S109), and if processes have not yet been performed for all pitch marks (step S109: No), returns to step S103 to repeat the processes for the next pitch mark.

If the frame is not determined as a voiced sound frame in step S101 (step S101: No), the noise source creation unit 206 creates an unvoiced sound source signal (noise source signal) using a noise signal stored in the third storage unit 223 (step S110).

After the noise source signal is generated in step S110 or it is determined in step S109 that the processes have been performed for all pitch marks (step S109: Yes), the connection unit 207 creates a sound source signal of the whole sentence by connecting the voiced sound mixed sound source signal obtained in step S109 and the unvoiced sound noise source signal obtained in step S110 (step S111).

The sound source signal generation unit 12 determines whether all frames have been processed (step S112), and if all frames have not yet been processed (step S112: No), returns to step S101 to repeat the processes. If all frames have been processed (step S112: Yes), the vocal tract filter unit 13 creates a synthetic speech by applying a vocal tract filter to the sound source signal of the whole sentence (step S113). Next, the waveform output unit 14 outputs the waveform of the synthetic speech (step S114), and then the processes end.

The order of speech synthesis processes are not limited to the order in FIG. 13 and may be changed appropriately. For example, creation of a sound source and vocal tract filter may be carried out simultaneously for each frame. After creating pitch marks for the whole sentence, the loop of speech frames may be performed.

By creating a mixed sound source signal according to the procedure described above, the need to apply a band-pass filter when a waveform is generated is eliminated so that the waveform can be generated faster than in the past. For example, the amount of calculation (the number of times of multiplication) to create a sound source of one point in a voiced sound portion is only B (the number of bands)×3 (intensity control of a pulse signal and noise signal and window application)×2 (synthesis by superimposition). Thus, compared with a case in which a waveform is generated while performing filtering of, for example, 50 taps (B×53×2), the amount of calculation can significantly be reduced.

In the above processing, a mixed sound source signal of the whole sentence is created by generation of a mixed sound source waveform (mixed sound source signal) for each pitch mark and superimposition thereof, but the creation is not limited to this. For example, a mixed sound source signal of the whole sentence can also be created by calculating the band noise intensity for each pitch mark by interpolation of the input band noise intensity, creating a mixed sound source signal for each pitch mark by multiplying the band noise signal stored in the first storage unit 221 by the calculated band noise intensity, and superimposing only band pulse signals in pitch mark positions.

As described above, the speech synthesizer 100 according the first embodiment creates band noise signals in advance to make processing faster. One feature of a white noise signal used as a noise source is that it has no periodicity. According to the method of storing a noise signal created in advance, periodicity depending on the length of the noise signal is generated. If, for example, the cyclic shift is used, periodicity of the period of the buffer length is generated. If the reciprocity shift is used, periodicity of twice the period of the buffer length is generated. The periodicity is not perceived when the length of the band noise signal exceeds a range, in which periodicity is perceived, and causes no problem. However, if the band noise signal whose length is within the range in which periodicity is perceived is prepared, an unnatural buzzer sound or an unnatural periodic sound is generated, leading to degraded tone quality of a synthetic speech. Regarding a band noise signal, a shorter noise signal is preferable in terms of the amount of memory because a shorter noise signal needs less storage area.

Figure 14:
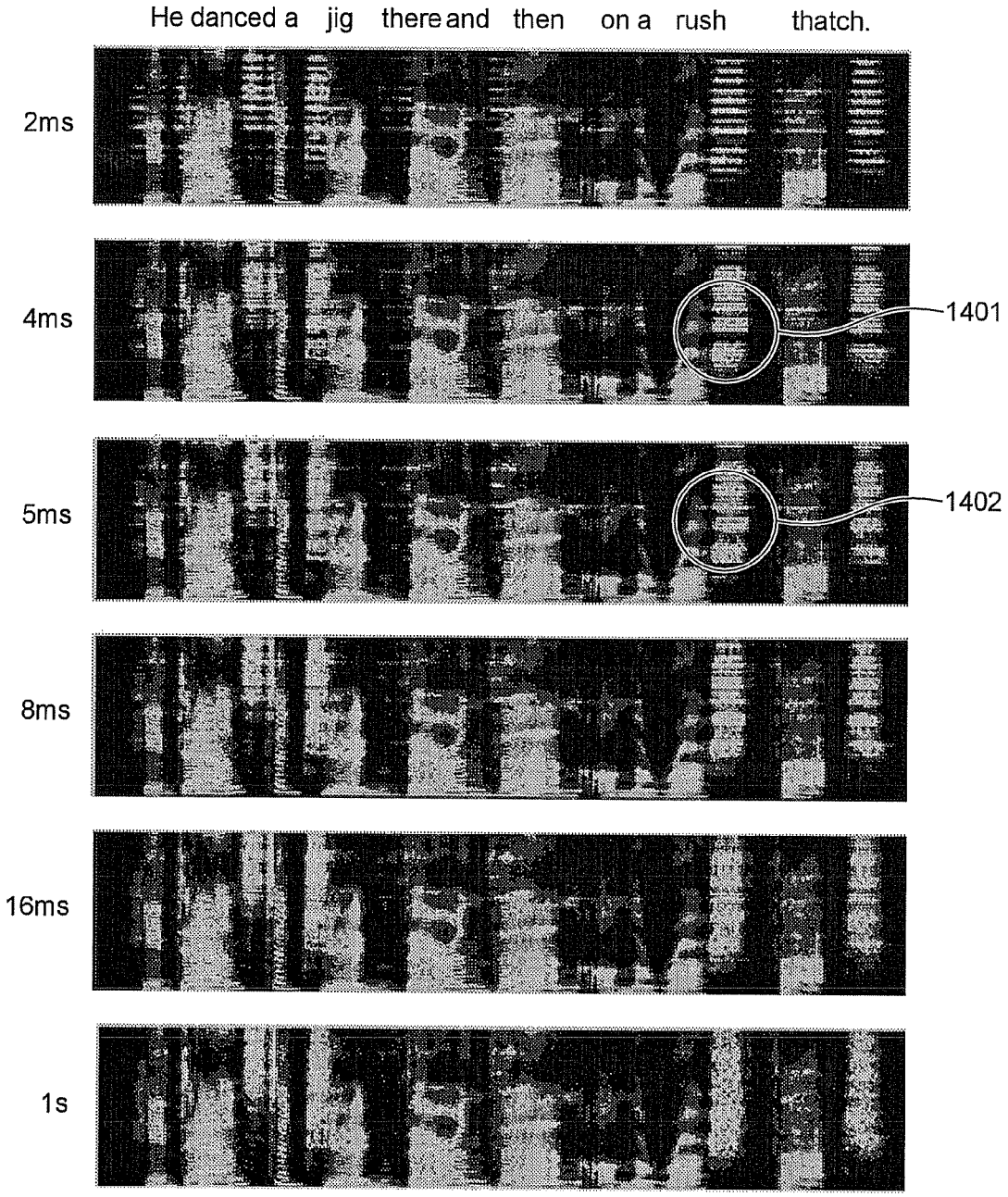
FIG. 14 is a diagram illustrating spectrograms of a synthetic speech.

In view of the above, the first storage unit 221 may be configured to store a band noise signal of the length of a predetermined length or more determined in advance as the minimum length to prevent degradation in tone quality. The predetermined length can be determined, for example, as follows. FIG. 14 is a diagram illustrating spectrograms of a synthetic speech when the length of a band noise signal is changed. FIG. 14 illustrates spectrograms in a case in which a sentence "He danced a jig there and then on a rush thatch" is synthesized when the length of the band noise signal is changed to 2 ms, 4 ms, 5 ms, 8 ms, 16 ms, and 1 s from above.

In the spectrum of 2 ms, lateral stripes are observed near phonemes of unvoiced sound portions "c, j, sh, ch". This is a spectrum that appears when periodicity is generated to create a buzzer-like sound. In this case, tone quality that can be used as a common synthetic speech is not obtainable. Stripe patterns in the horizontal direction decrease with an increasing length of the band noise signal and when the length is 16 ms or 1 s, almost no stripe pattern in the horizontal direction is observed. Comparison of these spectra shows that stripe patterns in the horizontal direction appear clearly when the length thereof is shorter than 5 ms. For example, while black horizontal lines clearly appear in a region 1401 of the spectrum near "sh" when the length is 4 ms, stripe patterns are less clear in a corresponding region 1402 when the length is 5 ms. This shows that the length of a band noise signal shorter than 5 ms is not usable, though the memory size becomes less.

From the above, the predetermined length may be set to 5 ms to configure the first storage unit 221 to store band noise signals whose length is 5 ms or more. Accordingly, a high-quality synthetic speech will be obtained. If band noise signals stored in the first storage unit 221 are made shorter, a higher-frequency signal tends to have shorter periodicity and a smaller amplitude. Therefore, the predetermined length may be longer at low frequency and may be shorter at high frequency. Alternatively, for example, only low-frequency components may be limited to the predetermined length (for example, 5 ms) or more so that high-frequency components may be shorter than the predetermined length. With these arrangements, band noise can be stored more efficiently and a high-quality synthetic speech can be obtained.

Figure 15:
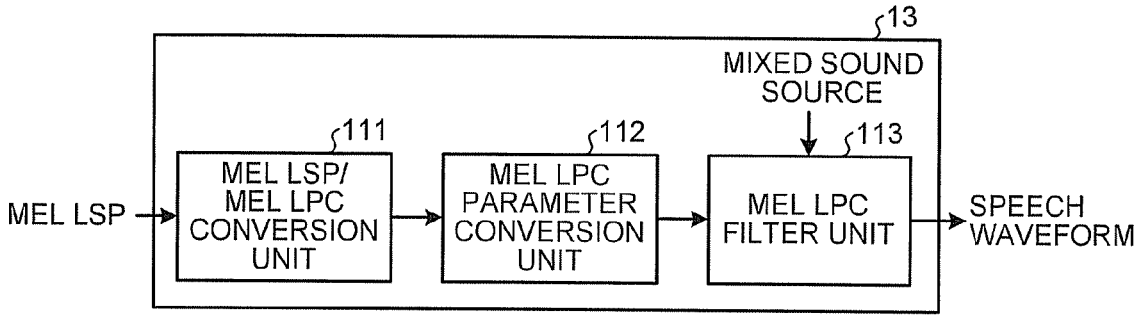
FIG. 15 is a block diagram of a vocal tract filter unit.

Next, details of the vocal tract filter unit 13 will be described. FIG. 15 is a block diagram illustrating a configuration example of the vocal tract filter unit 13. As illustrated in FIG. 15, the vocal tract filter unit 13 includes a mel LSP/mel LPC conversion unit 111, a mel LPC parameter conversion unit 112, and a mel LPC filter unit 113.

Figure 16:
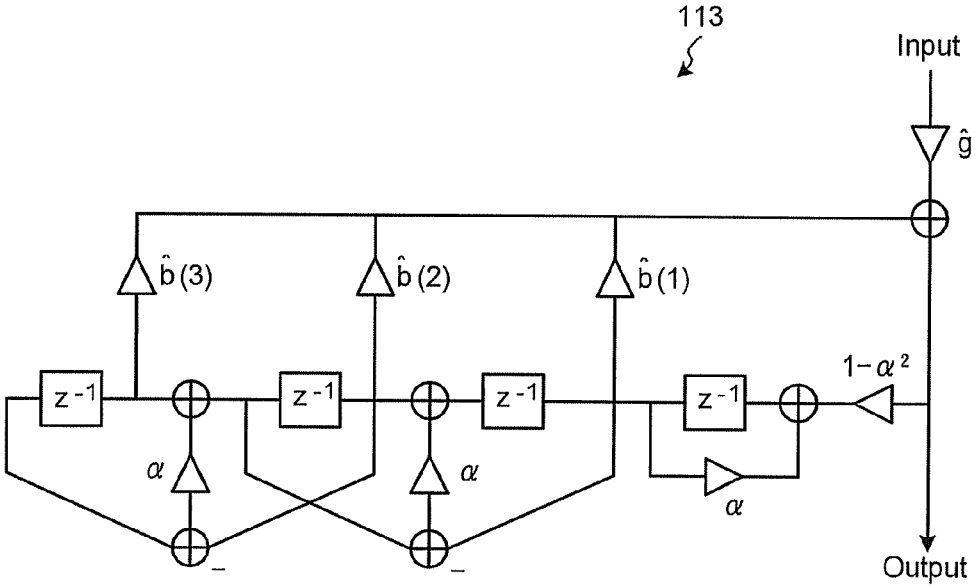
FIG. 16 is a circuit diagram of a mel LPC filter unit.

The vocal tract filter unit 13 performs filtering by the spectrum parameter. When a waveform is generated from mel LSP parameters, as illustrated in FIG. 15, first the mel LSP/mel LPC conversion unit 111 converts mel LSP parameters into mel LPC parameters. Next, the mel LPC parameter conversion unit 112 determines a filter parameter by performing processing to factor out a gain term from the converted mel LPC parameters. Next, the mel LPC filter unit 113 performs filtering by a mel LPC filter from the obtained filter parameter. FIG. 16 is a circuit diagram exemplifying the mel LPC filter unit 113.

The mel LSP parameter are parameters represented as $\omega_i$ and $\theta_i$ in Formula (4) below if the order is even and $A(z^{-1})$ is an expression representing the denominator of a transfer function.

$$A(\tilde{z}^{-1}) = 0.5[P(\tilde{z}^{-1}) + Q(\tilde{z}^{-1})] \tag{4}$$

where $$\begin{cases} P(\tilde{z}^{-1}) = (1 - \tilde{z}^{-1}) \prod_{i=2,4,\ \ldots} (1 - 2\cos\omega_i \tilde{z}^{-1} + \tilde{z}^{-2}) \\ Q(\tilde{z}^{-1}) = (1 + \tilde{z}^{-1}) \prod_{i=1,3,\ \ldots} (1 - 2\cos\theta_1 \tilde{z}^{-1} + \tilde{z}^{-2}), \end{cases}$$

$$\tilde{z}^{-1} = \frac{z^{-1} - \alpha}{1 - \alpha z^{-1}}.$$

The mel LSP/mel LPC conversion unit 111 calculates a coefficient $a_k$ obtained when these parameters are expanded in orders of $z^{-1}$. $\alpha$ denotes a frequency warping parameter and the value of 0.42 or the like is used for a speech of 16-kHz sampling. The mel LPC parameter conversion unit 112 factors out the gain term from the linear prediction coefficient $a_k$ obtained by expanding Formula (4) to create a parameter used for a filter. $b_k$ used in filter processing can be calculated from Formula (5) below:

$$\hat{b}_k = a_k - \alpha \hat{b}_{k+1} (m \ldots 1),\ \hat{b}_0 = 1 + \alpha \hat{b}_1$$

$$b_k = \hat{b}_k / \hat{b}_0,\ b_0 = 1$$

$$g' = g / \hat{b}_0, \tag{5}$$

The mel LSP parameters in FIG. 4 are denoted by $\omega_i$ and $\theta_i$, the gain term by g, and the converted gain term as g'. The mel LPC filter unit 113 in FIG. 16 performs filtering by using parameters obtained by the above processing.

Thus, the speech synthesizer 100 according to the first embodiment can synthesize a high-quality speech waveform at high speed using a suitably controlled mixed sound source signal by creating the mixed sound source signal using band noise signals stored in the first storage unit 221 and band pulse signals stored in the second storage unit 222 and using the mixed sound source signal as a vocal tract filter.

A speech synthesizer 200 according to a second embodiment receives pitch marks and a speech waveform and generates speech parameters by analyzing the speech based on a spectrum obtained by interpolation of pitch-synchronously analyzed spectra at a fixed frame rate. Accordingly, a precise speech analysis can be performed and by synthesizing a speech from speech parameters generated in this manner, a high-quality synthetic speech can be created.

Figure 17:
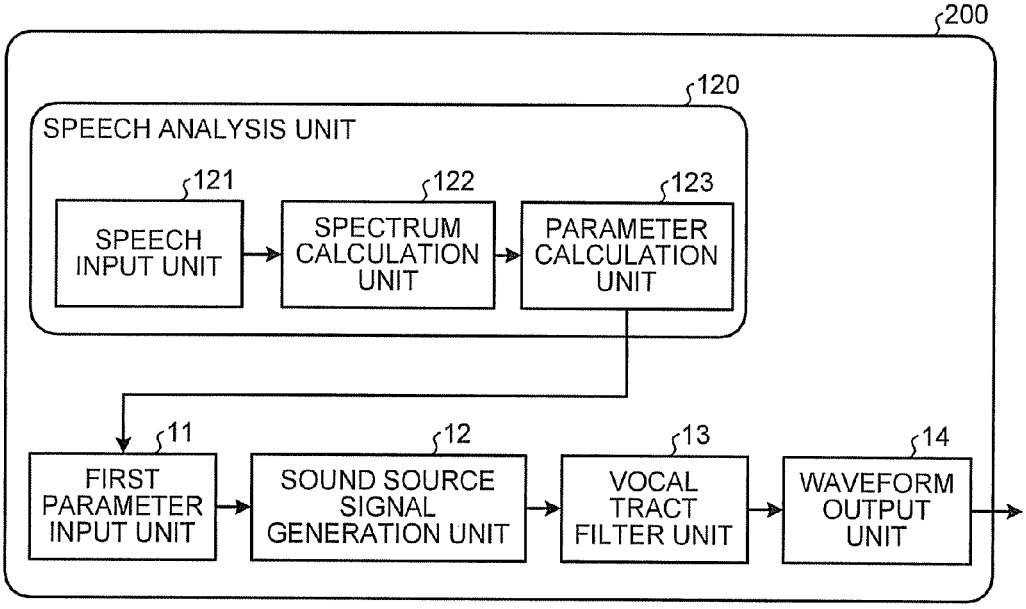
FIG. 17 is a block diagram of a speech synthesizer according to a second embodiment.

FIG. 17 is a block diagram exemplifying the configuration of the speech synthesizer 200 according to the second embodiment. As illustrated in FIG. 17, the speech synthesizer 200 includes a speech analysis unit 120 that analyzes an input speech signal, the first parameter input unit 11, the sound source signal generation unit 12, the vocal tract filter unit 13, and the waveform output unit 14.

The second embodiment is different from the first embodiment in that the speech analysis unit 120 is added. The other configuration and functions are the same as those in FIG. 1, which is a block diagram illustrating the configuration of the speech synthesizer 100 according to the first embodiment, and the same reference numerals are given thereto to omit the description thereof.

The speech analysis unit 120 includes a speech input unit 121 that inputs a speech signal, a spectrum calculation unit 122 that calculates a spectrum, and a parameter calculation unit 123 that calculates speech parameters from an obtained spectrum.

Processing by the speech analysis unit 120 will be described below. The speech analysis unit 120 calculates a speech parameter sequence from the input speech signal. It is assumed that the speech analysis unit 120 determines speech parameters at a fixed frame rate. That is, the speech analysis unit 120 determines and outputs speech parameters at time intervals of a fixed frame rate.

The speech input unit 121 inputs a speech signal to be analyzed. The speech input unit 121 may also input at the same time a pitch mark sequence with respect to a speech signal, fundamental frequency sequence, and frame determination information to determine whether it is a voiced frame or silent frame. The spectrum calculation unit 122 calculates a spectrum at a fixed frame rate from the input speech signal. If none of the pitch mark sequence, fundamental frequency sequence, and frame determination information is input, the spectrum calculation unit 122 also extracts the information. For the extraction, various voiced/silent determination methods, pitch extraction methods, and pitch mark creation methods that have been used can be used. For example, the above information can be extracted based on an autocorrelation value of the waveform. It is assumed below that the above information is provided in advance and input through the speech input unit 121.

The spectrum calculation unit 122 calculates a spectrum from the input speech signal. In the present embodiment, a spectrum at a fixed frame rate is calculated by interpolation of pitch-synchronously analyzed spectra.

The parameter calculation unit 123 determines spectrum parameters from the spectrum calculated by the spectrum calculation unit 122. When mel LSP parameters are used, the parameter calculation unit 123 calculates mel LPC parameters from power parameters to determine mel LSP parameters by converting mel LPC parameters.

Figure 18:
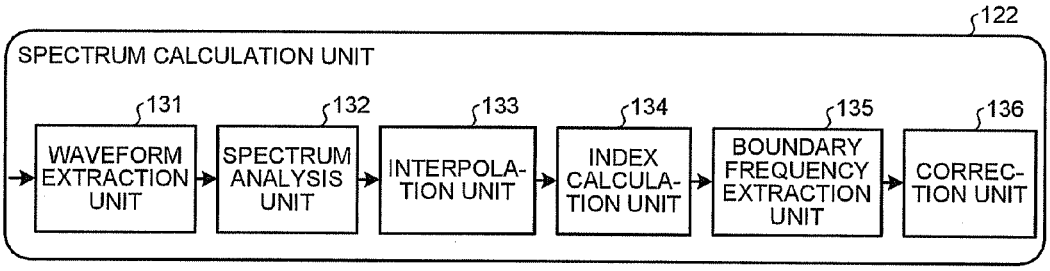
FIG. 18 is a block diagram of a spectrum calculation unit.
Figure 22:
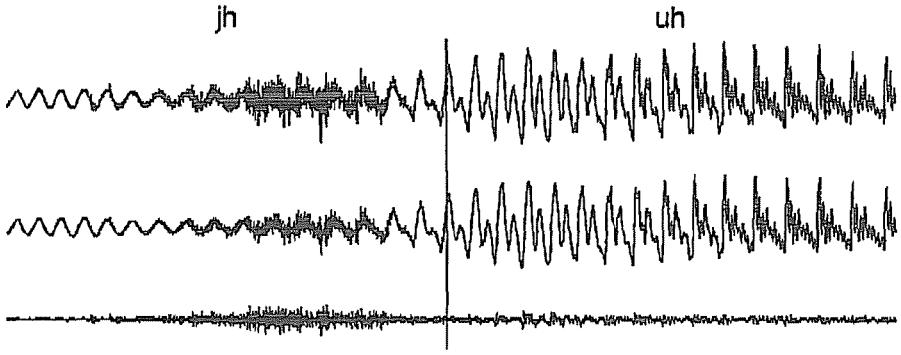
FIG. 22 is a diagram illustrating a speech waveform and a periodic component and a noise component of a speech waveform.

FIG. 18 is a block diagram illustrating a configuration example of the spectrum calculation unit 122. As illustrated in FIG. 22, the spectrum calculation unit 122 includes a waveform extraction unit 131, a spectrum analysis unit 132, an interpolation unit 133, an index calculation unit 134, a boundary frequency extraction unit 135, and a correction unit 136.

The spectrum calculation unit 122 extracts a pitch waveform by the waveform extraction unit 131 according to the pitch mark, determines the spectrum of the pitch waveform by means of the spectrum analysis unit 132, and interpolates the spectrum of adjacent pitch marks around the center of each frame at a fixed frame rate by means of the interpolation unit 133 to thereby calculate a spectrum in the frame. Details of the functions of the waveform extraction unit 131, the spectrum analysis unit 132, and the interpolation unit 133 will be described below.

The waveform extraction unit 131 extracts a pitch waveform by applying a Hanning window twice the pitch size, centering on the pitch mark position. The spectrum analysis unit 132 calculates the spectrum for a pitch mark by performing a Fourier transform of the obtained pitch waveform to determine an amplitude spectrum. The interpolation unit 133 determines a spectrum at a fixed frame rate by interpolating the spectrum in each pitch mark obtained as described above.

When an analysis of a fixed analysis window length and a fixed frame rate widely used in conventional spectrum analyses is performed, a speech is extracted by using a window function of a fixed analysis window length around the center position of a frame and a spectrum analysis of the spectrum around the center of each frame is performed from the extracted speech.

For example, an analysis by a Blackman window whose window length is 25 ms and the frame rate of 5 ms are used. In such a case, a window function whose length is several times the pitch is generally used and a spectrum analysis is performed by using a waveform containing periodicity of a speech waveform of a voiced sound or a waveform in which a voiced sound and an unvoiced sound are mixed. Thus, when a spectrum parameter is analyzed by the parameter calculation unit 123, parameterization to remove a fine structure of spectrum originating from periodicity is needed. Thus, it is difficult to use a characteristic parameter of high order. Moreover, a difference in phase in the center position of frames also affects spectrum analysis, and thus the determined spectrum may become unstable.

In contrast, if speech parameters are determined by interpolation of pitch-synchronously analyzed pitch waveforms of a spectrum like in the present embodiment, an analysis can be performed with a more appropriate analysis window length. Therefore, a precise spectrum is obtained and no fine fluctuation in the frequency direction caused by the pitch occurs. Also, a spectrum in which fluctuations of spectrum caused by phase shifts at the analysis center time are reduced is obtained so that precise characteristic parameters of high order can be determined.

The spectrum calculation by the STRAIGHT method described in Heiga Zen and Tomoki Toda, "An Overview of Nitech HMM-based Speech Synthesis System for Blizzard Challenge 2005," Proc. Of Interspeech 2005 (Eurospeech), pp. 93-96, Lisbon, September 2005 is carried out, like the present embodiment, by time direction smoothing and frequency direction smoothing of a spectrum whose length is about the pitch length. The STRAIGHT method performs the spectrum analysis from the fundamental frequency sequence and speech waveform without receiving a pitch mark. Fine structures of a spectrum caused by shifting of the analysis center position are removed by time-smoothing of the spectrum. A smooth spectrum envelope that interpolates between harmonics is determined by frequency-smoothing. However, it is difficult for the STRAIGHT method to analyze an interval from which it is difficult to extract the fundamental frequency such as a rising portion of a voiced plosive whose periodicity is not clear and a glottal stop and processing thereof is complex so that an efficient calculation cannot be carried out.

In the spectrum analysis according to the present embodiment, even an interval such as a voiced plosive, from which it is difficult to extract the fundamental frequency, can be analyzed without being significantly affected. This is achieved by attaching artificial pitch marks that smoothly change from adjacent pitch marks of voiced sound. Moreover, analysis can be carried out at high speed because calculations can be carried out by Fourier transforms and interpolation thereof. Therefore, according to the present embodiment, a precise spectrum envelope at each frame time from which an influence of periodicity of a voiced sound is removed can be determined by the speech analysis unit 120.

In the foregoing, the analysis method of a voiced sound interval holding pitch marks has been described. In an unvoiced sound interval, the spectrum calculation unit 122 performs a spectrum analysis using a fixed frame rate (for example, 5 ms) and a fixed window length (for example, a Hanning window whose length is 10 ms). The parameter calculation unit 123 converts an obtained spectrum into spectrum parameters.

The speech analysis unit 120 determines not only spectrum parameters, but also band intensity parameters (band noise intensity sequence) by similar processing. When a speech waveform (a periodic component speech waveform and a noise component speech waveform) separated into periodic components and noise components in advance is prepared and a band noise intensity sequence is to be determined by using the speech waveform, the speech input unit 121 inputs the periodic component speech waveform and the noise component speech waveform at the same time.

A speech waveform can be separated into a periodic component speech waveform and a noise component speech waveform by, for example, the method of Pitch-scaled Harmonic Filter (PSHF). PSHF uses Discrete Fourier Transform (DFT) whose length is several times the fundamental frequency. According to PSHF, a spectrum obtained by connecting spectra in positions other than positions of an integral multiple of the fundamental frequency is set as a noise component, a spectrum at positions of an integral multiple of the fundamental frequency is set as a periodic component spectrum, and waveforms created from each spectrum are determined to achieve separation into a noise component speech waveform and a periodic component speech waveform.

The method of separation into periodic components and noise components is not limited to this method. In the present embodiment, a case in which a noise component speech waveform is input by the speech input unit 121 together with a speech waveform, a noise component index of the spectrum is determined, and a band noise intensity sequence is calculated from the obtained noise component index will be described.

In this case, the spectrum calculation unit 122 calculates the noise component index simultaneously with the spectrum. The noise component index is a parameter indicating the ratio of the noise component in the spectrum. The noise component index is a parameter represented by the same number of points as that of the spectrum and representing the ratio of the noise component corresponding to each dimension of the spectrum as a value between 0 and 1. A parameter in dB may also be used.

The waveform extraction unit 131 extracts a noise component pitch waveform from the noise component waveform together with a pitch waveform for the input speech waveform. The waveform extraction unit 131 determines, like the pitch waveform, the noise component pitch waveform by window processing of twice the pitch length around the center of a pitch mark.

The spectrum analysis unit 132 performs, like the pitch waveform for the speech waveform, a Fourier transform of the noise component pitch waveform to determine a noise component spectrum at each pitch mark time.

The interpolation unit 133 determines, like a spectrum obtained from the speech waveform, a noise component spectrum at a relevant time by linear interpolation of noise component spectra at pitch mark times adjacent to each frame time.

The index calculation unit 134 calculates a noise component index indicating the ratio of the noise component spectrum to the amplitude spectrum of speech by dividing the obtained amplitude spectrum of the noise component (noise component spectrum) at each frame time by the amplitude spectrum of speech.

With the above processing, the spectrum and noise component index are calculated in the spectrum calculation unit 122.

The parameter calculation unit 123 determines band noise intensity from the obtained noise component index. The band noise intensity is a parameter indicating the ratio of the noise component in each band obtained by the predetermined band division and is determined from the noise component index. When the band-pass filter defined in FIG. 5 is used, the noise component index has a dimension determined by the number of points of the Fourier transform. In contrast, the noise component index in the present embodiment is equal to the dimension of the band division number. Thus, if the Fourier transform of 1024 points is used, for example, the noise component index becomes a parameter of 513 points and the band noise intensity a parameter of five points.

The parameter calculation unit 123 can calculate the band noise intensity as an average value in each band of the noise component index, an average value being assigned weights by filter characteristics, an average value being assigned weights by an amplitude spectrum or the like.

Spectrum parameters are determined, as described above, from a spectrum. Spectrum parameters and band noise intensity are determined by the above processing of the speech analysis unit 120. With the obtained spectrum parameters and band noise intensity, speech synthesis like in the first embodiment is performed. That is, the sound source signal generation unit 12 generates a sound source signal using obtained parameters. The vocal tract filter unit 13 generates a speech waveform by applying a vocal tract filter to the generated sound source signal. Then, the waveform output unit 14 outputs the generated speech waveform.

In the above processing, a spectrum and a noise component spectrum in each frame at a fixed frame rate are created from a spectrum and a noise component spectrum at each pitch mark time to calculate a noise component index. A noise component index in each frame at a fixed frame rate may also be calculated by calculating a noise component index at each pitch mark time and interpolating calculated noise component indexes. In both cases, the parameter calculation unit 123 creates a band noise intensity sequence from the created noise component index at each frame position. The above processing is described for a voiced sound interval with attached pitch marks and for an unvoiced sound interval. A band noise intensity sequence is created by assuming that all bands are noise components, that is, the band noise intensity is 1.

The spectrum calculation unit 122 may perform post-processing to obtain still higher-quality synthetic speech.

One example of the post-processing can be applied to low-frequency components of a spectrum. A spectrum extracted by the above processing tends to increase from a 0th-order DC component of a Fourier transform toward a spectrum component of a fundamental frequency position. If the rhythm is transformed using such a spectrum to lower the fundamental frequency, the amplitude of a fundamental frequency component will decrease. To avoid degradation in tone quality after the rhythm is transformed due to a decrease in amplitude of the fundamental frequency component, the amplitude spectrum in the fundamental frequency component position is copied and used as an amplitude spectrum between the fundamental frequency component and the DC component. Accordingly, a decrease in amplitude of the fundamental frequency component even if the rhythm is transformed in a direction to lower the fundamental frequency (F0) can be avoided so that degradation in tone quality can be avoided.

Post-processing can also be performed when a noise component index is determined. As post-processing after extracting the noise component index, for example, a method of correcting the noise component based on an amplitude spectrum can be used. The boundary frequency extraction unit 135 and the correction unit 136 perform such post-processing. If no post-processing should be performed, there is no need to include the boundary frequency extraction unit 135 and the correction unit 136.

The boundary frequency extraction unit 135 extracts the maximum frequency having a value exceeding the threshold of a predetermined spectrum amplitude value for a voiced sound spectrum and sets the frequency as a boundary frequency. The correction unit 136 corrects the noise component index, such as setting the noise component index to 0, in a band lower than the boundary frequency so that all components are driven by a pulse signal.

For a voiced fricative, the boundary frequency extraction unit 135 extracts as a boundary frequency the maximum frequency having a value exceeding the threshold of a predetermined spectrum amplitude value within a range in which the value monotonously increases or decreases from the predetermined initial value of the boundary frequency. The correction unit 136 corrects the noise component index to 0 so that all components in the band lower than the boundary frequency are driven as pulse components and further corrects the noise component index to 1 so that all frequency components higher than the boundary frequency are noise components.

Accordingly, generation of a powerful noisy speech waveform caused by a powerful component of a voiced sound being handled as a noise component is reduced. Moreover, generation of a pulse-like speech waveform with a high buzzing sense due to handling of a noise component in a high-frequency component or the like of a voiced fricative as a pulse driven component under the influence of a separation error or the like can be suppressed.

Figure 19:
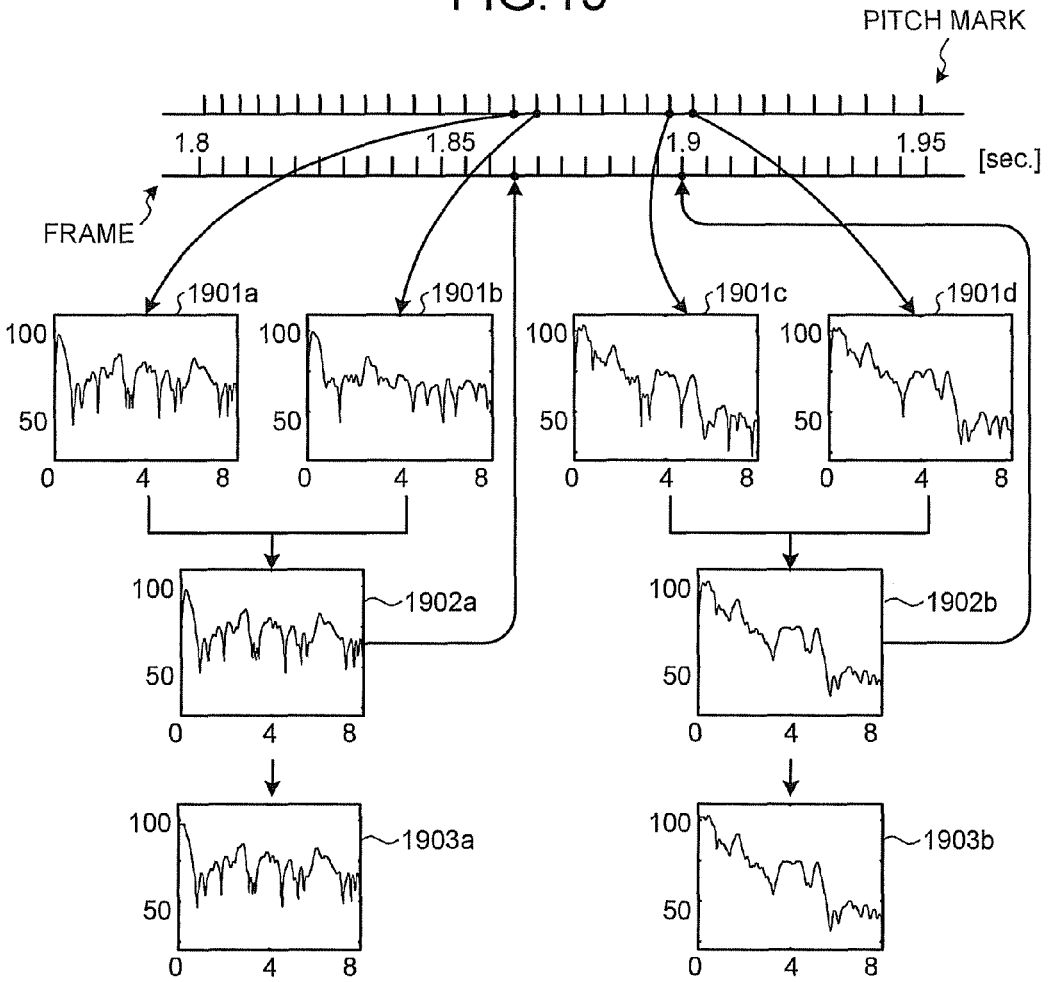
FIG. 19 is a diagram illustrating an example where a speech analysis unit analyzes a speech waveform.

A specific example of speech parameter generation processing according to the second embodiment will be described below using FIGS. 19 to 21. FIG. 19 is a diagram illustrating an example in which the speech analysis unit 120 analyzes the speech waveform, illustrated in FIG. 8, which is the source to be analyzed. The uppermost part of FIG. 19 illustrates pitch marks and the part below the uppermost part illustrates the center of an analysis frame. Pitch marks in FIG. 8 are created from the fundamental frequency sequence for waveform generation. In contrast, pitch marks in FIG. 19 are determined from a speech waveform and attached in synchronization with the period of the speech waveform. The center of the analysis frame represents an analysis frame at a fixed frame rate of 5 ms. A spectrum analysis of two frames (1.865 s and 1.9 s) denoted by black circles in FIG. 19 will be shown below as an example.

Spectra 1901*a* to 1901*d* illustrate spectra (pitch synchronous spectra) analyzed in pitch mark positions before or after the frame to be analyzed. The spectrum calculation unit 122 applies a Hanning window twice the length of the pitch to the speech waveform and performs a Fourier transform to calculate pitch synchronous spectra.

Spectra 1902*a* and 1902*b* show spectra (frame spectra) of the frame to be analyzed created by interpolation of pitch synchronous spectra. If the time of the frame is t, the spectrum thereof $X_t(\omega)$, the time of the previous pitch mart $t_p$, the spectrum thereof $X_p(\omega)$, the time of the next pitch mart $t_n$, and the spectrum thereof $X_n(\omega)$, the interpolation unit 133 calculates the frame spectrum $X_t(\omega)$ of the frame at time t by Formula (6) below:

$$X_t(\omega) = \frac{(t_n - t)X_p(\omega) + (t - t_p)X_n(\omega)}{(t_n - t_p)} \tag{6}$$

Spectra 1903*a* and 1903*b* show post-processed spectra obtained by applying the above post-processing of replacing the amplitude between the DC component and the fundamental frequency component with the amplitude at the fundamental frequency position to the spectra 1902*a* and 1902*b* respectively. Accordingly, an amplitude attenuation of the $F_0$ component when the rhythm is transformed to lower the pitch can be suppressed.

Figure 20:
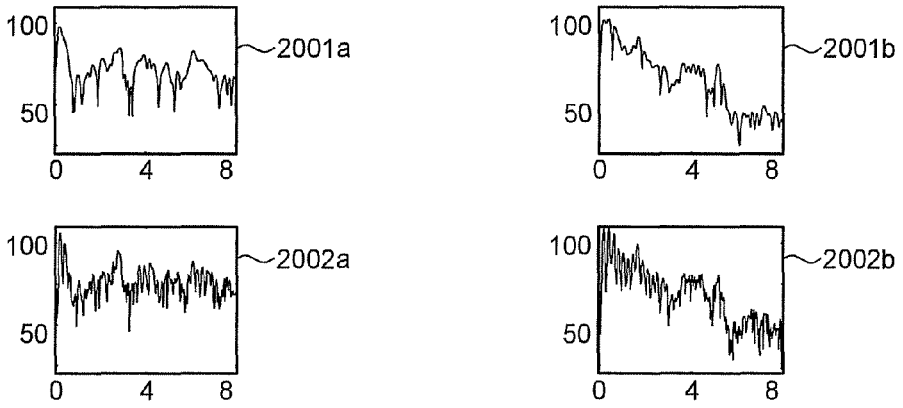
FIG. 20 is a diagram exemplifying spectra analyzed centering on a frame position.

FIG. 20 is a diagram exemplifying spectra determined by analysis centering on the frame position for comparison. Spectra 2001*a* and 2001*b* show examples of spectra when a window function whose length is twice the pitch is used for analysis. Spectra 2002*a* and 2002*b* show examples when a window function of a fixed length of 25 ms is used for analysis.

The spectrum 2001*a* of the frame of 1.865 s is a spectrum close to the prior spectrum because the frame position is close to the previous pitch mark and is also close to the spectrum (the spectrum 1902*a* in FIG. 19) of the frame created by interpolation. In contrast, the spectrum 2001*b* of the frame of 1.9 s has fine fluctuations of spectrum because the center position of the frame significantly deviates from the pitch mark position, creating a great difference from the frame spectrum (the spectrum 1902*b* in FIG. 19) created by interpolation. That is, by using a spectrum based on an interpolation frame as illustrated in FIG. 19, a spectrum in a frame position apart from a pitch mark position can also be calculated with stability.

A spectrum of a fixed window length like spectra 2002*a* and 2002*b* has fine fluctuations of spectrum due to an influence of pitch and a spectrum envelope is not created so that it is difficult to determine a precise spectrum parameter of high order.

Figure 21:
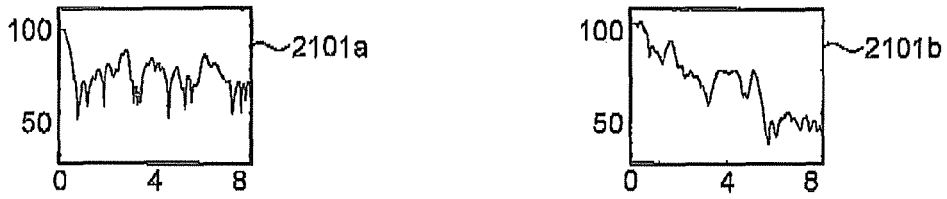
FIG. 21 is a diagram exemplifying 39th-order mel LSP parameters.

FIG. 21 is a diagram exemplifying 39th-order mel LSP parameters determined from the post-processed spectra (spectra 1903*a* and 1903*b*) in FIG. 19. Parameters 2101*a* and 2101*b* denote mel LSP parameters determined from spectra 1903*a* and 1903*b* respectively.

Mel LSP parameters in FIG. 21 show the mel LSP value (frequency) by a line and are plotted together with the spectrum. The mel LSP parameters are used as spectrum parameters.

Figure 23:
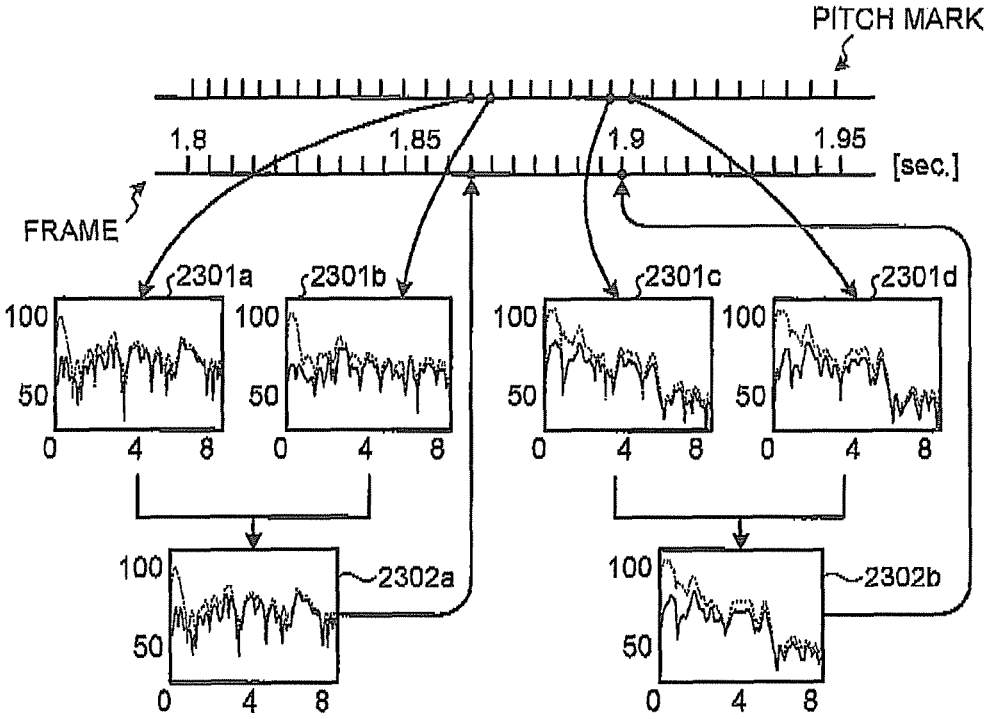
FIG. 23 is a diagram illustrating an example where the speech analysis unit analyzes the speech waveform.

FIGS. 22 to 27 are diagrams illustrating an example of analyzing a band noise component. FIG. 22 is a diagram illustrating the speech waveform in FIG. 8 and a periodic component and a noise component of the speech waveform. The waveform in the upper part of the FIG. 22 represents the speech waveform of the source to be analyzed. The waveform in the center part of the FIG. 22 represents the speech waveform of a periodic component as a result of separating the speech waveform by PSHF. The waveform in the lower part of the FIG. 22 represents the speech waveform of a noise component. FIG. 23 is a diagram illustrating an example in which the speech analysis unit 120 analyzes the speech waveform in FIG. 22. Like in FIG. 19, the uppermost part of FIG. 23 illustrates pitch marks and the part below the uppermost part illustrates the center of an analysis frame.

Spectra 2301*a* to 2301*d* show spectra (pitch synchronous spectra) of the noise component pitch-synchronously analyzed based on pitch marks before and after the focused frame. Spectra 2302*a* to 2302*b* show noise component spectra (frame spectra) of each frame created by interpolation of noise components of prior and subsequent pitch marks using Formula (6). In FIG. 23, a solid line denotes the spectrum of the noise component and a dotted line denotes the spectrum of the entire speech.

Figure 24:
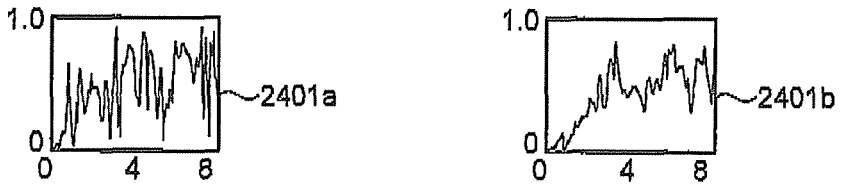
FIG. 24 is a diagram exemplifying a noise component index.

FIG. 24 is a diagram exemplifying the noise component index determined from the noise component spectrum and the spectrum of the entire speech. Noise component indexes 2401*a* and 2401*b* correspond to the spectra 2302*a* and 2302*b* of FIG. 23, respectively. If the spectrum is $X_t(\omega)$ and the noise component spectrum is $X_t^{ap}(\omega)$, the index calculation unit 134 calculates a noise component index $AP_t(\omega)$ according to Formula (7) below:

$$AP_t(\omega) = \frac{X_t(\omega)}{X_t^{ap}(\omega)} \tag{7}$$

Figure 25:
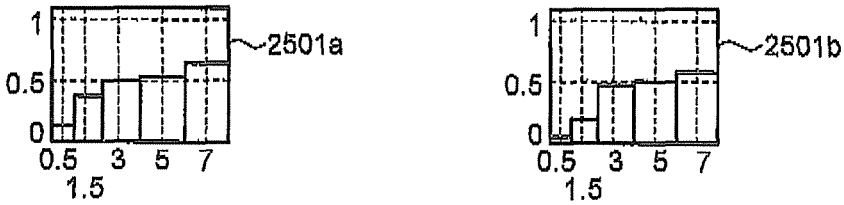
FIG. 25 is a diagram exemplifying band noise intensity.

FIG. 25 is a diagram exemplifying band noise intensities 2501*a* and 2501*b* determined from the noise component indexes 2401*a* and 2401*b* in FIG. 24, respectively. In the present embodiment, frequencies 1, 2, 4, and 6 [kHz] are set as boundaries of five bands and band noise intensity is calculated using a weighting average value of the noise component index between frequencies. That is, the parameter calculation unit 123 uses the amplitude spectrum as weighting and calculates band noise intensity $BAP_t$ (b) according to Formula (8) below, in which the addition range is defined by frequencies within the range of corresponding band:

$$BAP_t(b) = \frac{\sum X_t(\omega) AP_t(\omega)}{\sum X_t(\omega)} \quad (8)$$

With the above processing, the band noise intensity can be determined using a noise component waveform separated from a speech waveform and the speech waveform. The band noise intensity determined in this manner is synchronized with the mel LSP parameter determined by the method described with reference to FIGS. 19 to 21 in the time direction. Thus, a speech waveform can be generated from the band noise intensity determined as described above and the mel LSP parameter.

If post-processing of the noise component extraction described above should be performed, boundary frequencies are extracted and the noise component index is corrected based on the obtained boundary frequencies. The post-processing used here divides the processing for a voiced fricative and for other voiced sounds. For example, the phoneme "jh" is a voiced fricative and the phoneme "uh" is a voiced sound so that different post-processing are performed, respectively.

Figure 26:
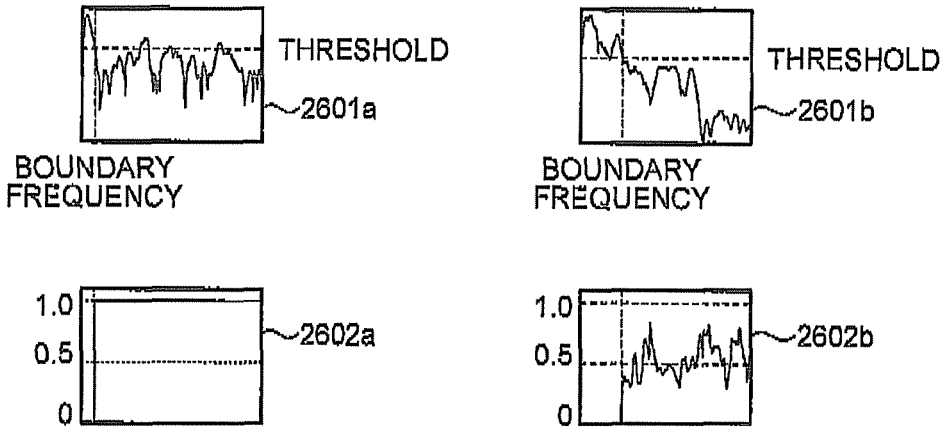
FIG. 26 is a diagram illustrating a specific example of post-processing.

FIG. 26 is a diagram illustrating a specific example of post-processing. Graphs 2601*a* and 2601*b* show thresholds for boundary frequency extraction and obtained boundary frequencies. For a voiced fricative (graph 2601*a*), a boundary where the amplitude becomes larger than the threshold near 500 Hz is extracted and the boundary is set as a boundary frequency. For other voiced sounds (graph 2601*b*), the maximum frequency at which the amplitude exceeds the threshold is extracted and set as a boundary frequency.

As illustrated in FIG. 26, for a voiced fricative, the noise component index is corrected to a noise component index 2602*a* in which the value thereof is 0 in the band equal to the boundary frequency or less and 1 in the band greater than the boundary frequency. For other voiced sounds, the noise component index is corrected to a noise component index 2602*b* in which the value thereof is 0 in the band equal to or less than the boundary frequency and the determined value in the band greater than the boundary frequency.

Figure 27:
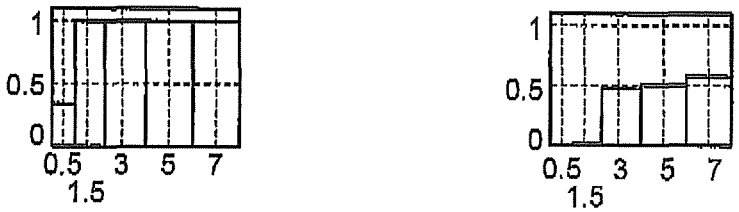
FIG. 27 is a diagram illustrating the band noise intensity obtained from a boundary frequency.

FIG. 27 is a diagram illustrating the band noise intensity obtained from the boundary frequency created as described above based on Formula (8). Band noise intensities 2701*a* and 2701*b* correspond to the noise component indexes 2602*a* and 2602*b* in FIG. 26, respectively.

With the above processing, a high-frequency component of a voiced fricative can be synthesized from a noise source and a low-frequency component of a voiced sound can be synthesized from a pulse sound source, and thus a waveform is generated more appropriately. Further, like the spectrum, the noise component index equal to or less than the fundamental frequency component may be used as the value of the noise component index in the fundamental frequency component as post-processing. Accordingly, a noise component index synchronized with a post-processed spectrum can be obtained.

Figure 28:
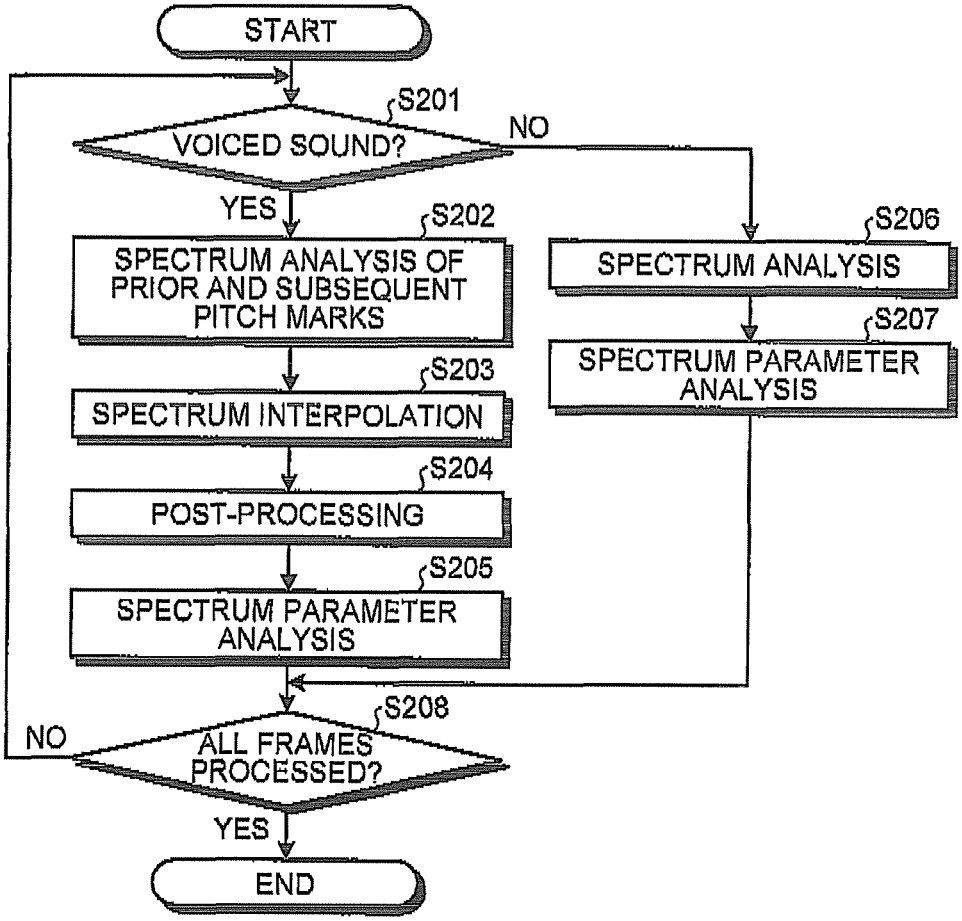
FIG. 28 is a flow chart illustrating the overall flow of spectrum parameter calculation processes in the second embodiment.

Next, spectrum parameter calculation processes by the speech synthesizer 200 according to the second embodiment will be described using FIG. 28. FIG. 28 is a flow chart illustrating the overall flow of spectrum parameter calculation processes in the second embodiment. The processes in FIG. 28 is started after a speech signal and pitch marks are input by the speech input unit 121 and performed in units of speech frames.

First, the spectrum calculation unit 122 determines whether or not the frame to be processed is a voiced sound (step S201). If the frame is a voiced sound frame (step S201; Yes), the waveform extraction unit 131 extracts pitch waveforms according to pitch marks before and after the frame. Then, the spectrum analysis unit 132 performs a spectrum analysis of the extracted pitch waveforms (step S202).

Next, the interpolation unit 133 interpolates obtained spectra of prior and subsequent pitch marks according to Formula (6) (step S203). Next, the spectrum calculation unit 122 performs post-processing on the obtained spectrum (step S204). Here, the spectrum calculation unit 122 corrects the amplitude in the band equal to or less than the fundamental frequency. Next, the parameter calculation unit 123 performs a spectrum parameter analysis to convert the corrected spectrum into speech parameters such as mel LSP parameters.

If the frame is determined to an unvoiced sound in step S201 (step S201: No), the spectrum calculation unit 122 performs a spectrum analysis of each frame (step S206). Then, the parameter calculation unit 123 performs a spectrum parameter analysis of each frame (step S207).

Next, the spectrum calculation unit 122 determines whether all frames have been processed (step S208) and, if all frames have not yet been processed (step S208: No), returns to step S201 to repeat the processes. If all frames have been processed (step S208: Yes), the spectrum calculation unit 122 ends the spectrum parameter calculation processes. Through the above processes, a spectrum parameter sequence is determined.

Figure 29:
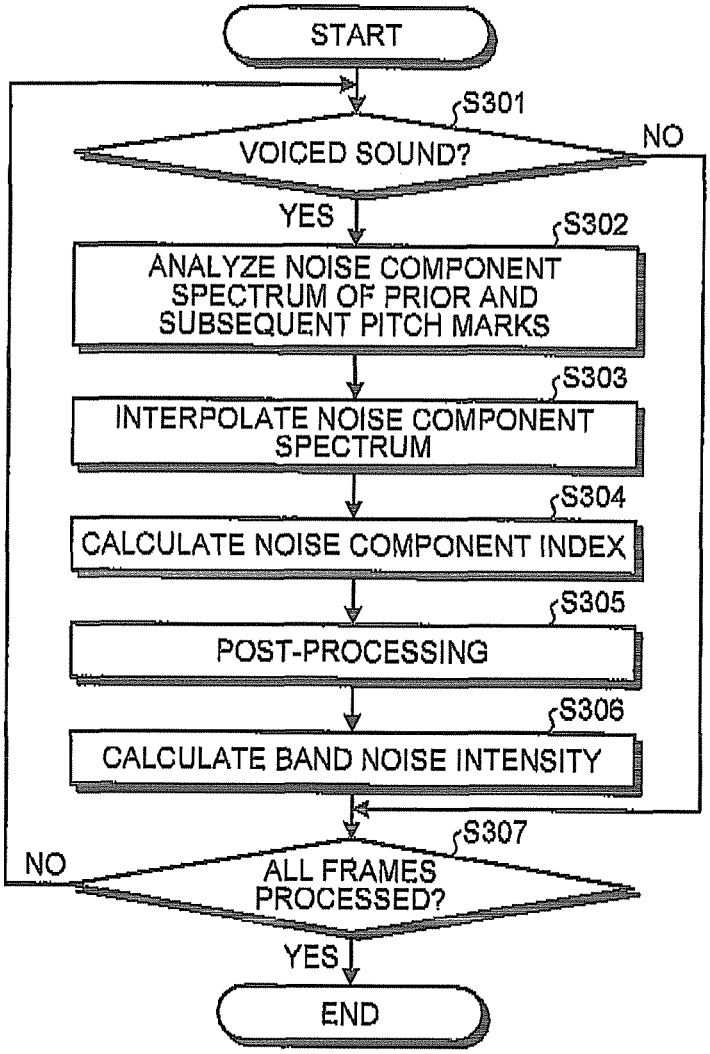
FIG. 29 is a flow chart illustrating the overall flow of band noise intensity calculation processes in the second embodiment.

Next, band noise intensity calculation processes by the speech synthesizer 200 according to the second embodiment will be described using FIG. 29. FIG. 29 is a flow chart illustrating the overall flow of band noise intensity calculation processes in the second embodiment. The processes in FIG. 28 is started after a speech signal, a noise component of the speech signal, and pitch marks are input by the speech input unit 121 and performed in units of speech frames.

First, the spectrum calculation unit 122 determines whether or not the frame to be processed is a voiced sound (step S301). If the frame is a voiced sound frame (step S301: Yes), the waveform extraction unit 131 extracts pitch waveforms of the noise component according to pitch marks before and after the frame and then, the spectrum analysis unit 132 performs a spectrum analysis of the extracted pitch waveforms of the noise component (step S302). Next, the interpolation unit 133 interpolates noise component spectra of prior and subsequent pitch marks and calculates a noise component spectrum of the frame (step S303). Next, the index calculation unit 134 calculates a noise component index according to Formula (7) from a spectrum obtained by the spectrum analysis of the speech waveform in step S202 of FIG. 28 and the noise component spectrum (step S304).

Next, the boundary frequency extraction unit 135 and the correction unit 136 perform post-processing to correct the noise component index (step S305). Next, the parameter calculation unit 123 calculates band noise intensity from the obtained noise component index using Formula (8) (step S306). If the frame is determined to be an unvoiced sound in step S301, processes performed by setting the band noise intensity to 1.

Next, the spectrum calculation unit 122 determines whether all frames have been processed (step S307) and, if all frames have not yet been processed (step S307: No), returns to step S301 to repeat the processes. If all frames have been processed (step S307: Yes), the spectrum calculation unit 122 ends the band noise intensity calculation processes. Through the above processes, a band noise intensity sequence is determined.

Thus, the speech synthesizer 200 according to the second embodiment can perform a precise speech analysis using a spectrum obtained by inputting pitch marks and a speech waveform, and then interpolating pitch-synchronously analyzed spectra at a fixed frame rate. Then, a high-quality synthetic speech can be created by synthesizing a speech from analyzed speech parameters. Further, the noise component index and band noise intensity can be analyzed similarly so that a high-quality synthetic speech can be created.

In addition to a speech synthesizer that generates a speech waveform with speech parameters being input, an apparatus that synthesizes a speech from input text data (hereinafter, referred to simply as text) is also called a speech synthesizer. As one such speech synthesizer, speech synthesis based on the hidden Markov model (HMM) is proposed. In the speech synthesis based on the HMM, HMM in phonemes taking various kinds of context information (such as the position in a sentence, position in a breath group, position in a word, and phonemic environment therearound) into consideration is constructed by state clustering based on the maximum likelihood estimation and the decision tree. When a speech is synthesized, a distribution sequence is created by tracing a decision tree based on context information obtained by converting input text and a speech parameter sequence is generated from the obtained distribution sequence. A speech waveform is generated from speech parameter sequence by using, for example, a source-filter type speech synthesizer based on a mel cepstrum. A smooth connected speech is synthesized by adding dynamic characteristic quantities to the output distribution of HMM and generating a speech parameter sequence using a parameter generation algorithm in consideration of the dynamic characteristic quantities.

In Heiga Zen and Tomoki Toda, "An Overview of Nitech HMM-based Speech Synthesis System for Blizzard Challenge 2005," Proc. Of Interspeech 2005 (Eurospeech), pp. 93-96, Lisbon, September 2005, as a kind of speech synthesis based on the HMM, a speech synthesis system using a STRAIGHT parameter is proposed. STRAIGHT is an analysis/synthesis method of speech that performs an $F_0$ extraction, non-periodic component (noise component) analysis, and spectrum analysis. According to this method, a spectrum analysis is performed based on time direction smoothing and frequency direction smoothing. When a speech is synthesized, Gaussian noise and pulses are mixed in a frequency domain from these parameters and a waveform is generated using a fast Fourier transform (FFT).

In a speech synthesizer described in Heiga Zen and Tomoki Toda, "An Overview of Nitech HMM-based Speech Synthesis System for Blizzard Challenge 2005," Proc. Of Interspeech 2005 (Eurospeech), pp. 93-96, Lisbon, September 2005, a spectrum analyzed by STRAIGHT is converted into a mel cepstrum and a noise component is converted into band noise intensities of five bands to learn the HMM. When a speech is synthesized, these parameters are generated from an HMM sequence obtained from input text, the obtained mel cepstrum and band noise intensities are converted into a spectrum and noise component of STRAIGHT to obtain a waveform of synthetic speech using a waveform generation unit of STRAIGHT. Thus, the method according to Heiga Zen and Tomoki Toda, "An Overview of Nitech HMM-based Speech Synthesis System for Blizzard Challenge 2005," Proc. Of Interspeech 2005 (Eurospeech), pp. 93-96, Lisbon, September 2005. uses the waveform generation unit of STRAIGHT. Consequently, a large amount of calculation is needed for parameter conversion processing, FFT processing for waveform generation and the like and thus, a waveform cannot be generated at high speed and a longer processing time is needed.

A speech synthesizer according to a third embodiment learns an HMM using speech parameters analyzed by, for example, the method in the second embodiment and inputs any sentence by using the obtained HMM to generate speech parameters corresponding to the input sentence. Then, the speech synthesizer generates a speech waveform by a method similar to that of a speech synthesizer according to the first embodiment.

Figure 30:
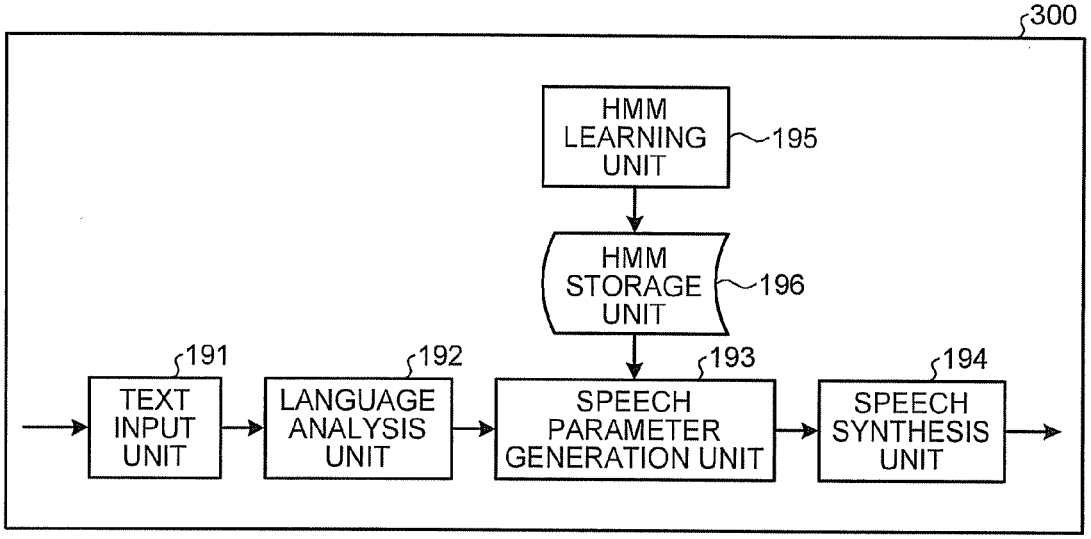
FIG. 30 is a block diagram of a speech synthesizer according to a third embodiment.

FIG. 30 is a block diagram exemplifying the configuration of a speech synthesizer 300 according to the third embodiment. As illustrated in FIG. 30, the speech synthesizer 300 includes an HMM learning unit 195, an HMM storage unit 196, a text input unit 191, a language analysis unit 192, a speech parameter generation unit 193, and a speech synthesis unit 194.

The HMM learning unit 195 learns an HMM using spectrum parameters, which are speech parameters analyzed by the speech synthesizer 200 according to the second embodiment, a band noise intensity sequence, and a fundamental frequency sequence. At this point, dynamic characteristic quantities of these parameters are also used as parameters to learn the HMM. The HMM storage unit 196 stores parameters of the model of HMM obtained from the learning.

The text input unit 191 inputs text to be synthesized. The language analysis unit 192 performs morphological analysis processing of text and outputs language information, such as reading accents, used for speech synthesis. The speech parameter generation unit 193 generates speech parameters using a model learned by the HMM learning unit 195 and stored in the HMM storage unit 196.

The speech parameter generation unit 193 constructs an HMM (sentence HMM) in units of sentences according to a phoneme sequence and accent information sequence obtained as a result of language analysis. A sentence HMM is constructed by connecting and arranging HMMs in units of phonemes. As the HMM, a model created by implementing decision tree clustering for each state and stream can be used. The speech parameter generation unit 193 traces the decision tree according to the input attribute information to create phonemic models by using the distribution of leaf nodes as the distribution of each state of the HMM and arranges created phonemic models to create a sentence HMM. The speech parameter generation unit 193 generates speech parameters from an output probability parameter of the created sentence HMM. First, the speech parameter generation unit 193 decides the number of frames corresponding to each state from a model of the duration distribution of each state of the HMM to generate parameters of each frame. Smoothly connected speech parameters are generated by using a generation algorithm that takes dynamic characteristic quantities into consideration for parameter generation. The learning of HMM and parameter generation can be carried out according to the method described in Heiga Zen and Tomoki Toda, "An Overview of Nitech HMM-based speech Synthesis System for Blizzard Challenge 2005," Proc. Of Interspeech 2005 (Eurospeech), pp. 93-96, Lisbon, September 2005.

The speech synthesis unit 194 generates a speech waveform from generated speech parameters. The speech synthesis unit 194 generates a waveform from a band noise intensity sequence, fundamental frequency sequence, and spectrum parameter sequence by a method similar to that of the speech synthesizer 100 according to the first embodiment. Accordingly, a waveform can be generated from a mixed sound source signal in which a pulse component and a noise component are appropriately mixed at high speed.

As described above, the HMM storage unit 196 stores the HMM learned by the HMM learning unit 195. In the present embodiment, the HMM is described in units of phonemes, but the unit of semi-phonemes obtained by dividing a phoneme or the unit containing several phonemes such as a syllable may also be used, as well as the unit of the phoneme. The HMM is a statistical model having several states and is composed of the output distribution for each state and state transition probabilities showing probabilities of state transitions.

Figure 31:
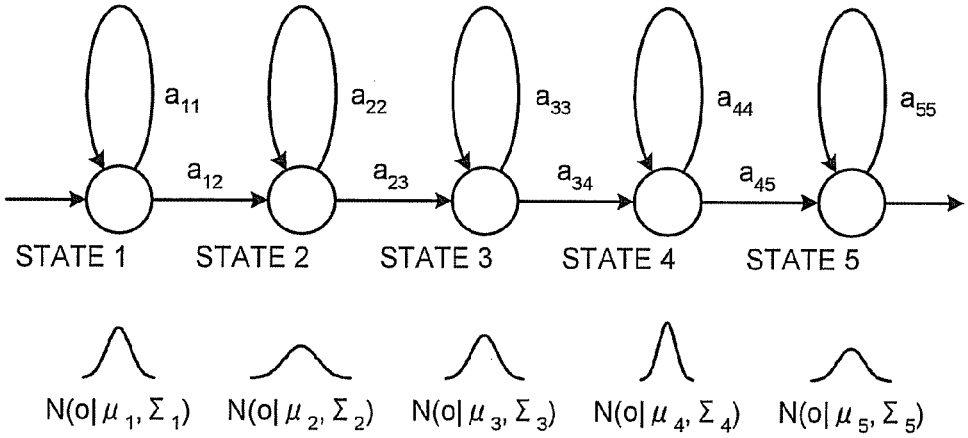
FIG. 31 is a diagram exemplifying a left-right type HMM.

FIG. 31 is a diagram exemplifying a left-right type HMM. As illustrated in FIG. 31, the left-right type HMM is a type of HMM in which only a transition from a left state to a right state and a self-transition occur and is used for modeling of time series information of speech and the like. FIG. 31 illustrates a 5-state model in which the state transition probability from state i to state j is denoted as $a_{ij}$ and the output distribution based on the Gaussian distribution as $N(o|\mu_s, \Sigma_s)$.

Figure 32:
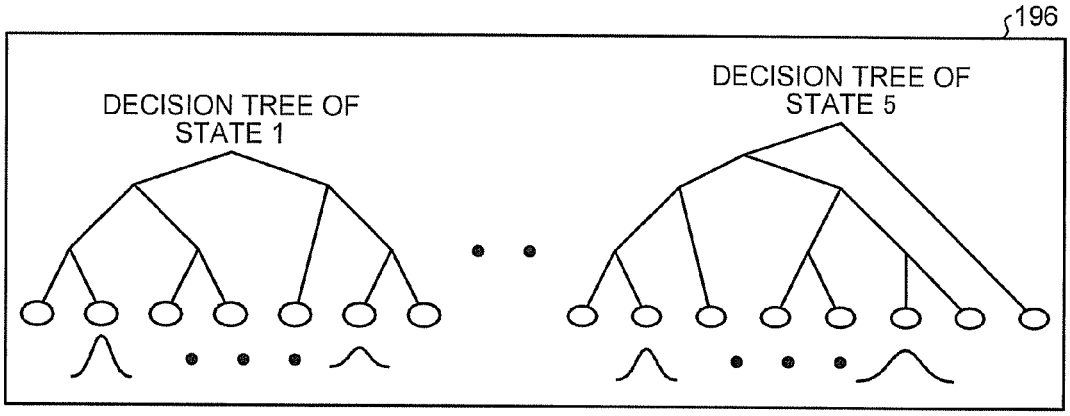
FIG. 32 is a diagram exemplifying a decision tree.

The HMM storage unit 196 stores the HMM as described above. However, the Gaussian distribution for each state is stored in a form shared by a decision tree. FIG. 32 is a diagram exemplifying the decision tree. As illustrated in FIG. 32, the HMM storage unit 196 stores the decision tree in each state of the HMM and a leaf node holds a Gaussian distribution.

A question to select a child node based on the phoneme or language attributes is held by each node of the decision tree. Questions stored include, for example, "Is the central phoneme a voiced sound?", "Is the number of phonemes from the beginning of a sentence 1?", "The distance from the accent core is 1", "The phoneme is a vowel", and "The left phoneme is "a"". The speech parameter generation unit 193 can select the distribution by tracing the decision tree based on a phoneme sequence and language information obtained by the language analysis unit 192.

Attributes used include a {preceding, relevant, following} phoneme, the syllable position in a word of the phoneme, the {preceding, relevant, following} part of speech, the number of syllables in a {preceding, relevant, following} word, the number of syllables from an accent syllable, the position of a word in a sentence, presence/absence of pause before and after, the number of syllables in a {preceding, relevant, following} breath group, the position of the breath group, and the number of syllables of a sentence. A label containing such information for each phoneme is called a context label. Such decision trees can be created for each stream of a characteristic parameter. Learning data O as shown in Formula (9) below is used as the characteristic parameter.

$$O=(o_1,o_2,\ldots,o_T)$$

$$o_t=(c'_t,\Delta c'_t,\Delta^2 c'_t,b'_t,\Delta b'_t,\Delta^2 b'_t,f'_t,\Delta f'_t,\Delta^2 f'_t)' \quad (9)$$

A frame $o_t$ at time t of O includes a spectrum parameter $c_t$, a band noise intensity parameter $b_t$, and a fundamental frequency parameter $f_t$ and Δ is attached to these delta parameters representing dynamic characteristics and $\Delta^2$ to second-order Δ parameters. The fundamental frequency is represented as a value indicating an unvoiced sound in an unvoiced sound frame. An HMM can be learned from learning data in which a voiced sound and an unvoiced sound are mixed thanks to the HMM based on the probability distribution on a multi-space.

A stream refers to something picked out from a characteristic vector such as each characteristic parameter like $(c'_t, \Delta c'_t, \Delta^2 c'_t)$, $(b'_t, \Delta b'_t, \Delta^2 b'_t)$, and $(f'_t, \Delta f'_t, \Delta^2 f'_t)$. The decision tree for each stream means that a decision tree is held for a decision tree representing a spectrum parameter, a band noise intensity parameter b, and a fundamental frequency parameter f. In this case, based on the phoneme sequence and language attributes input for synthesis, each Gaussian distribution is decided by tracing each decision tree for each state of the HMM and an output distribution is created by combining Gaussian distributions to create an HMM.

Figure 33:
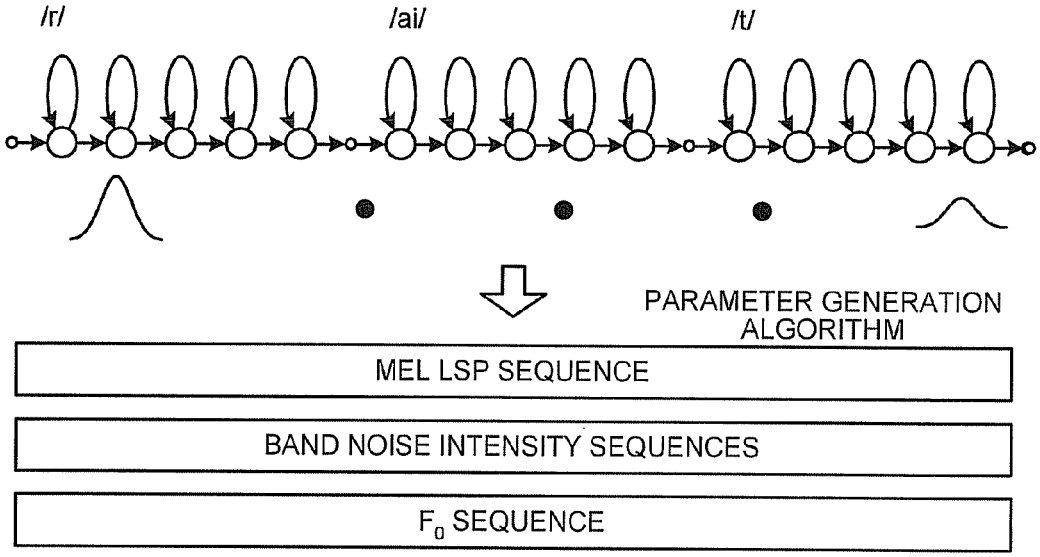
FIG. 33 is a diagram illustrating speech parameter generation processing.

A case in which, for example, a speech "right (r·ai·t)" is synthesized will be described. FIG. 33 is a diagram illustrating speech parameter generation processing of this example. As illustrated in FIG. 33, the whole HMM is created by connecting an HMM for each phoneme and speech parameters are created from the output distribution of each state. The output distribution of each state of the HMM is selected from the decision tree stored in the HMM storage unit t96. The speech parameter generation unit 193 generates speech parameters from these average vectors and covariance matrices. Speech parameters can be generated by the parameter generation algorithm based on dynamic characteristic quantities used also by Heiga Zen and Tomoki Toda, "An Overview of Nitech HMM-based Speech Synthesis System for Blizzard Challenge 2005," Proc. Of Interspeech 2005 (Eurospeech), pp. 93-96, Lisbon, September 2005. An algorithm that generates parameters from other output distributions of the HMM such as the linear interpolation or spline interpolation of average vectors may also be used. Through the above processing, a sequence (mel LSP sequence) of the vocal tract filter for a synthesized sentence, a band noise intensity sequence, and a sequence of speech parameters based on the fundamental frequency ($F_0$) sequence are generated.

The speech synthesis unit 194 generates a speech waveform from speech parameters generated as described above by a method similar to that of the speech synthesizer 100 according to the first embodiment. Accordingly, a speech waveform can be generated using a mixed sound source signal mixed appropriately at high speed.

Figure 34:
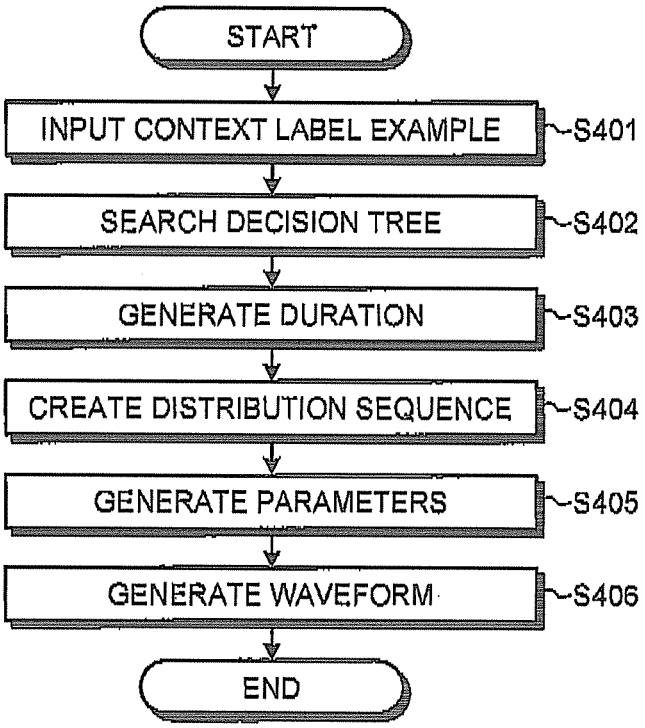
FIG. 34 is a flow chart illustrating the overall flow of speech synthesis processes in the third embodiment.

The HMM learning unit 195 learns the HMM from a speech signal a label sequence thereof used as learning data. Like Heiga Zen and Tomoki Toda, "An Overview of Nitech HMM-based Speech Synthesis System for Blizzard Challenge 2005," Proc. Of Interspeech 2005 (Eurospeech), pp. 93-96, Lisbon, September 2005, the HMM learning unit 195 creates a characteristic parameter represented by Formula (9) from each speech signal and uses the characteristic parameter for learning. A speech analysis can be performed by the processing of the speech analysis unit 120 of the speech synthesizer 200 in the second embodiment. The HMM learning unit 195 learns the HMM from the obtained characteristic parameter and context labels to which attribute information used for decision tree construction is attached. Normally, learning is implemented as learning of HMM by phoneme, learning of context dependent HMM, state clustering based on the decision tree using the MDL standard for each stream, and maximum likelihood estimation of each model. The HMM learning unit 195 causes the HMM storage unit 196 to store the decision tree and Gaussian distribution obtained in this way. Further, the HMM learning unit 195 also learns the distribution showing the duration of each state at the same time, implements decision tree clustering, and stores the distribution and decision tree clustering in the HMM storage unit 196. Through the above processing, HMM parameters used for speech synthesis are learned. Next, speech synthesis processing by the speech synthesizer 300 according to the third embodiment will be described using FIG. 34. FIG. 34 is a flow chart illustrating the overall flow of speech synthesis processes in the third embodiment.

The speech parameter generation unit 193 inputs a context label sequence obtained as a result of language analysis by the language analysis unit 192 (step S401). The speech parameter generation unit 193 searches the decision tree stored in the HMM storage unit 196 and creates a state duration model and an HMM (step S402). Next, the speech parameter generation unit 193 decides the duration for each state (step S403). Next, the speech parameter generation unit 193 creates a distribution sequence of spectrum parameters of the whole sentence, band noise intensity, and fundamental frequency according to the duration (step S404). The speech parameter generation unit 193 generates parameters from the distribution sequence (step S405) to obtain a parameter sequence corresponding to a desired sentence. Next, the speech synthesis unit 194 generates a speech waveform from obtained parameters (step S406).

Thus, in the speech synthesizer 300 according to the third embodiment, a synthetic speech corresponding to an arbitrary sentence can be created by using a speech synthesizer according to the first or second embodiment and the HMM speech synthesis.

Figure 35:
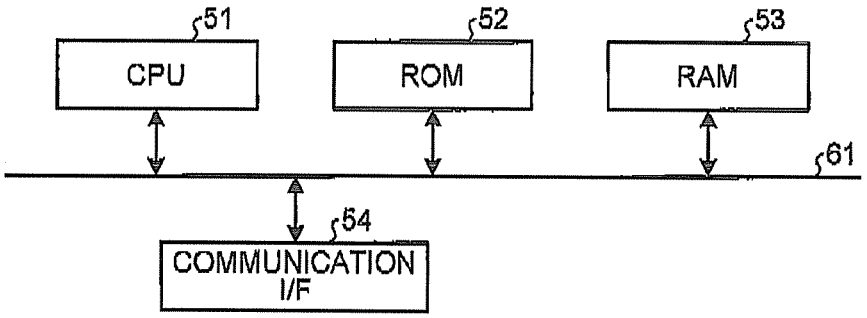
FIG. 35 is a hardware block diagram of the speech synthesizers according to the first to third embodiments.

According to the first to third embodiments, as described above, a mixed sound source signal is created using stored band noise signals and band pulse signals and is used as an input to a vocal tract filter. Thus, a high-quality speech waveform can be synthesized at high speed Next, the hardware configuration of a speech synthesizer according to the first to third embodiments will be described using FIG. 35. FIG. 35 is an explanatory view illustrating the hardware configuration of the speech synthesizer according to the first to third embodiments.

The speech synthesizer according to the first to third embodiments includes a control apparatus such as a Central Processing Unit (CPU) 51, a storage apparatus such as a Read Only Memory (ROM) 52 and a Random Access Memory (RAM) 53, a communication interface 54 to perform communication by connecting to a network, and a bus 61 to connect each unit.

A program executed by the speech synthesizer according to the first to third embodiments is provided by being incorporated into the ROM 52 or the like in advance.

The program executed by the speech synthesizer according to the first to third embodiments may be configured to be recorded in a computer readable recording medium such as a Compact Disk Read Only Memory (CD-ROM), flexible disk (FD), Compact Disk Recordable (CD-R), and Digital Versatile Disk (DVD) in the form of an installable or executable file and provided as a computer program product.

Further, the program executed by the speech synthesizer according to the first to third embodiments may be configured such that the program is stored on a computer connected to a network, such as the Internet, and is downloaded over the network to be provided. Alternatively, the program executed by the speech synthesizer according to the first to third embodiments may be configured to be provided or distributed over a network such as the Internet.

The program executed by the speech synthesizer according to the first to third embodiments can cause a computer to function as the individual units (the first parameter input unit, sound source signal generation unit, vocal tract filter unit, and waveform output unit) of the above speech synthesizer. The CPU 51 in the computer can read the program from a computer readable recording medium into a main storage apparatus, and then execute the program.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirits of the inventions.

What is claimed is:

1. A speech synthesizer comprising:

a first storage unit configured to store n (n is an integer equal to or greater than 2) number of band noise signals obtained by applying each of n number of band-pass filters corresponding to n number of passing bands to a noise signal;

a second storage unit configured to store n number of band pulse signals obtained by applying each of the band-pass filters to a pulse signal;

a parameter input unit configured to input a fundamental frequency sequence of a speech to be synthesized, n number of band noise intensity sequences that show noise intensity of each of the passing bands, and a spectrum parameter sequence;

an extraction unit configured to extract, for each samples of the speech to be synthesized, the band noise signal stored in the first storage unit by shifting the position in the band noise signal;

an amplitude control unit configured to change, for each of the passing bands, an amplitude of the extracted band noise signal and the amplitude of the band pulse signal in accordance with the band noise intensity sequence of the passing band;

a generation unit configured to generate, for the each pitch mark being created from the fundamental frequency sequence, a mixed sound source signal created by adding the band noise signal whose amplitude has been changed and the band pulse signal whose amplitude has been changed;

a second generation unit configured to generate a mixed sound source signal for the speech from the mixed sound source signal for the each pitch mark; and a vocal tract filter unit configured to generate a speech waveform by applying a vocal tract filter, which uses the spectrum parameter sequence, to the generated mixed sound source signal.

2. The speech synthesizer according to claim 1, further comprising:

a speech input unit configured to input a speech signal and the pitch marks;

a waveform extraction unit configured to extract a speech waveform by applying a window function, centering on the pitch mark, to the speech signal;

a spectrum analysis unit configured to calculate a speech spectrum representing a spectrum of the speech waveform by performing a spectrum analysis of the speech waveform;

an interpolation unit configured to calculate the speech spectrum at each frame time at a predetermined frame rate by interpolating the speech spectra of a plurality of the adjacent pitch marks at each frame time at the frame rate; and a parameter calculation unit configured to calculate the spectrum parameter sequence based on the speech spectrum obtained by the interpolation unit, wherein the parameter input unit inputs the fundamental frequency sequence, the band noise intensity sequences, and the spectrum parameter sequence calculated.

3. The speech synthesizer according to claim 1, further comprising:

a speech input unit configured to input a speech signal, a noise component of the speech signal, and the pitch marks;

a waveform extraction unit configured to extract the speech waveform by applying a window function, centering on the pitch mark, to the speech signal and a noise component waveform by applying the window function, centering on the pitch mark, to the noise component;

a spectrum analysis unit configured to calculate a speech spectrum representing a spectrum of the speech waveform and a noise component spectrum representing the spectrum of the noise component by performing a spectrum analysis of the speech waveform and the noise component waveform;

an interpolation unit configured to calculate the speech spectrum and the noise component spectrum at each frame time at a predetermined frame rate by interpolating the speech spectra and noise component spectra of a plurality of the adjacent pitch marks at each frame time at the frame rate, and calculate a noise component index indicating a ratio of the noise component spectrum to the calculated speech spectrum or calculates the noise component index indicating the ratio of the noise component spectrum to the calculated speech spectrum at each frame time at the frame rate by interpolating the ratio of the noise component spectra to the speech spectra of the plurality of the adjacent pitch marks at each frame time at the frame rate; and a parameter calculation unit configured to calculate the band noise intensity sequences based on the calculated noise component index, wherein the parameter input unit inputs the fundamental frequency sequence, the band noise intensity sequences calculated, and the spectrum parameter sequence.

4. The speech synthesizer according to claim 3, wherein the speech input unit inputs the speech signal, the noise component representing a component other than integral multiples of a fundamental frequency of the spectrum of the speech signal, and the pitch marks.

5. The speech synthesizer according to claim 3, further comprising:

a boundary frequency extraction unit configured to extract a boundary frequency, which is a maximum frequency exceeding a predetermined threshold, from the spectrum of a voiced sound; and a correction unit configured to correct the noise component index so that the sound source signal in a frequency band lower than the boundary frequency becomes the pulse signal.

6. The speech synthesizer according to claim 3, further comprising:

a boundary frequency extraction unit configured to extract a boundary frequency, which is a maximum frequency exceeding a predetermined threshold within a range monotonously increasing or decreasing from a predetermined initial frequency, from the spectrum of a voiced fricative; and a correction unit configured to correct the noise component index such that the sound source signal in a frequency band lower than the boundary frequency becomes the pulse signal.

7. The speech synthesizer according to claim 1, further comprising:

a hidden Markov model storage unit configured to store hidden Markov model parameters in predetermined speech units, the hidden Markov model parameters containing output probability distribution parameters of the fundamental frequency sequence, the band noise intensity sequences, and the spectrum parameter sequence;

a language analysis unit configured to analyze the speech units contained in input text data; and a speech parameter generation unit configured to generate the fundamental frequency sequence, the band noise intensity sequences, and the spectrum parameter sequence for the input text data based on the analyzed speech units and the hidden Markov model parameters, wherein the parameter input unit inputs the fundamental frequency sequence generated, band noise intensity sequences generated, and spectrum parameter sequence generated.

8. The speech synthesizer according to claim 1, wherein the band noise signal stored in the first storage unit has a length equal to or more than a predetermined length as a minimum length to prevent degradation in tone quality.

9. The speech synthesizer according to claim 8, wherein the predetermined length is 5 ms.

10. The speech synthesizer according to claim 1, wherein the band noise signal stored in the first storage unit whose corresponding passing band is large is longer than the band noise signal whose corresponding passing band is small and the band noise signal whose corresponding passing band is small has a length equal to or more than a predetermined length as a minimum length to prevent degradation in tone quality.

11. The speech synthesizer according to claim 1, wherein the noise signal is Gaussian noise signal, and the pulse signal includes only one peak.

12. A speech synthesis method executed by a speech synthesizer having a first storage unit that stores n (n is an integer equal to or greater than 2) number of band noise signals obtained by applying each of n number of band-pass filters corresponding to n number of passing bands to a noise signal and a second storage unit that stores n number of band pulse signals obtained by applying each of the band-pass filters to a pulse signal, the method comprising:

inputting a fundamental frequency sequence of a speech to be synthesized, n number of band noise intensity sequences that show noise intensity of each of the passing bands, and a spectrum parameter sequence;

extraction, for each samples of the speech to by synthesized, the band noise signals stored in the first storage unit by shifting the position in the each of the band noise signals;

changing, for each of the passing bands, an amplitude of the extracted band noise signal and the amplitude of the band pulse signal in accordance with the band noise intensity sequence of the passing band;

generating, for the each pitch mark being created from the fundamental frequency sequence, a mixed sound source signal created by adding the band noise signals whose amplitude has been changed and the band pulse signals whose amplitude has been changed;

generating a mixed sound source signal for the speech from the mixed sound source signal for the each pitch mark; and generating a speech waveform by applying a vocal tract filter, which uses the spectrum parameter sequence, to the generated mixed sound source signal.

13. A computer program product having a non-transitory computer readable medium including programmed instructions, wherein the instructions, when executed by a computer, causes the computer to function as:

a first storage unit that stores n (n is an integer equal to or greater than 2) number of band noise signals obtained by applying each of n number of band-pass filters corresponding to n number of passing bands to a noise signal;

a second storage unit that stores n number of band pulse signals obtained by applying each of the band-pass filters to a pulse signal;

a parameter input unit that inputs a fundamental frequency sequence of a speech to be synthesized, n number of band noise intensity sequences that show noise intensity of each of the passing bands, and a spectrum parameter sequence;

an extraction unit that extracts, for each samples of the speech to be synthesized, the band noise signal stored in the first storage unit by shifting the position in the band noise signal;

an amplitude control unit that changes, for each of the passing bands, an amplitude of the extracted band noise signal and the amplitude of the band pulse signal in accordance with the band noise intensity sequence of the passing band;

a generation unit that generates, for the each pitch mark being created from the fundamental frequency sequence, a mixed sound source signal created by adding the band noise signal whose amplitude has been changed and the band pulse signal whose amplitude has been changed;

a second generation unit that generates a mixed sound source signal for the speech from the mixed sound source signal for the each pitch mark; and a vocal tract filter unit that generates a speech waveform by applying a vocal tract filter, which uses the spectrum parameter sequence, to the generated mixed sound source signal.

* * * * *